US007114971B1

(12) United States Patent
Johnson et al.

(10) Patent No.: US 7,114,971 B1
(45) Date of Patent: Oct. 3, 2006

(54) MULTI-SYSTEM PLUG-IN POWER RECEPTACLE FOR MODULAR POWER DISTRIBUTION SYSTEM

(75) Inventors: Ross S. Johnson, Jenison, MI (US); Duane R. Danz, Byron Center, MI (US); Derek D. Crow, Wayland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 11/165,148

(22) Filed: Jun. 23, 2005

(51) Int. Cl.
*H01R 4/60* (2006.01)

(52) U.S. Cl. ..... 439/211; 439/215

(58) Field of Classification Search ..... 439/211, 439/925, 209, 207, 215, 687
See application file for complete search history.

(56) References Cited

U.S. PATENT DOCUMENTS

| | | | | | |
|---|---|---|---|---|---|
| 1,536,522 | A | | 5/1925 | Pellegren | 439/651 |
| 4,553,808 | A | | 11/1985 | Weidler et al. | 434/391 |
| 4,775,328 | A | * | 10/1988 | McCarthy | 439/211 |
| 4,781,609 | A | | 11/1988 | Wilson et al. | 439/215 |
| 4,952,164 | A | | 8/1990 | French et al. | 439/215 |
| 5,024,610 | A | | 6/1991 | French et al. | 439/857 |
| 5,092,787 | A | * | 3/1992 | Wise et al. | 439/215 |
| 5,096,431 | A | | 3/1992 | Byrne | 439/171 |
| 5,171,159 | A | | 12/1992 | Byrne | 439/215 |
| 5,203,711 | A | * | 4/1993 | Bogiel | 439/215 |
| 5,203,712 | A | * | 4/1993 | Kilpatrick et al. | 439/215 |
| 5,236,370 | A | | 8/1993 | King et al. | 439/215 |
| 5,252,086 | A | * | 10/1993 | Russell et al. | 439/215 |
| 5,425,659 | A | | 6/1995 | Banks | 439/650 |
| 5,503,565 | A | * | 4/1996 | McCoy | 439/171 |
| 5,595,495 | A | | 1/1997 | Johnson et al. | 439/215 |
| 5,748,424 | A | | 5/1998 | Hung | 361/56 |
| 6,123,562 | A | * | 9/2000 | King et al. | 439/215 |
| 6,575,777 | B1 | | 6/2003 | Henriott et al. | 439/215 |

* cited by examiner

*Primary Examiner*—Michael C. Zarroli
(74) *Attorney, Agent, or Firm*—Flynn, Thiel, Boutell & Tanis, P.C.

(57) ABSTRACT

A modular power distribution system is provided having a power distribution assembly (PDA) which is mountable in office furniture and the like. A plurality of plug-in receptacles are provided which plug in to the PDA. The receptacles have a multi-system design which uses common internal components and an external housing which has a support structure therein readily adapted to allow adaptation of the design of the housing for use with multiple power distribution systems.

21 Claims, 36 Drawing Sheets

FIG. 37
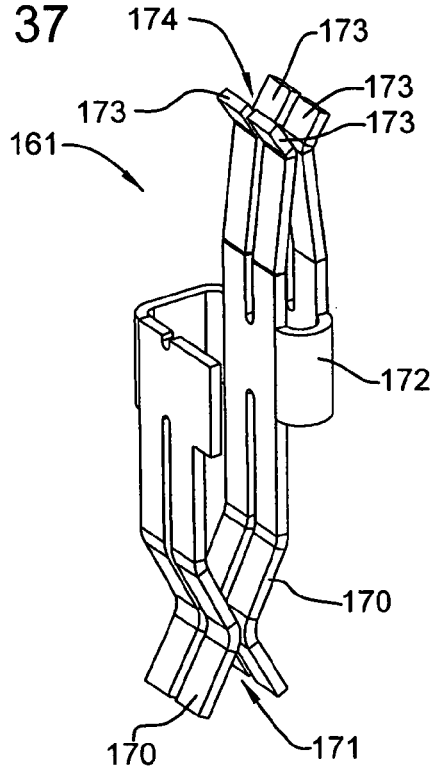
FIG. 39
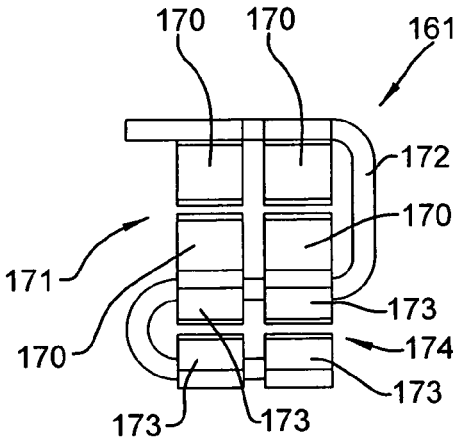
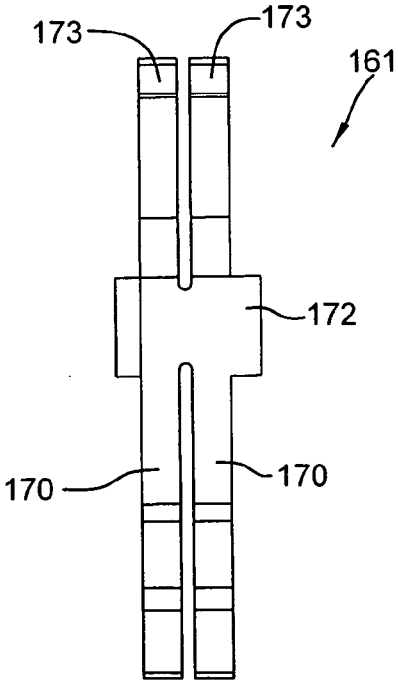
FIG. 40
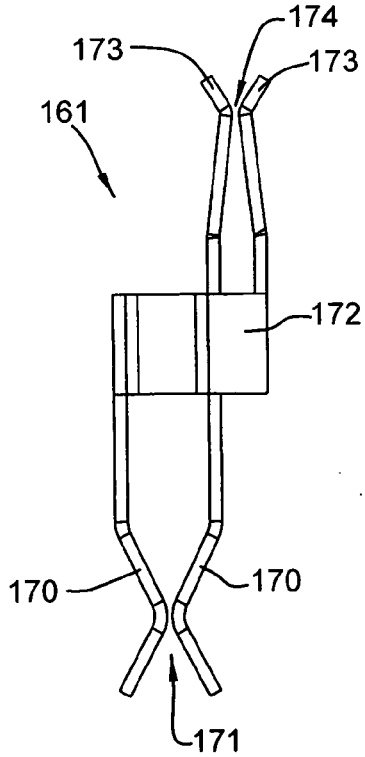
FIG. 38

Title: MULTI-SYSTEM PLUG-IN POWER RECEPTACLE FOR MODULAR POWER DISTRIBUTION SYSTEM
Inventor(s): Ross S. JOHNSON et al.
Serial No.: 11/165 148
Docket No.: 2000.P0343US
Replacement Sheet

32/36

Title: MULTI-SYSTEM PLUG-IN POWER RECEPTACLE FOR MODULAR POWER DISTRIBUTION SYSTEM
Inventor(s): Ross S. JOHNSON et al.
Serial No.: 11/165 148
Docket No.: 2000.P0343US
Replacement Sheet

34/36

Title: MULTI-SYSTEM PLUG-IN POWER RECEPTACLE FOR MODULAR POWER DISTRIBUTION SYSTEM
Inventor(s): Ross S. JOHNSON et al.
Serial No.: 11/165 148
Docket No.: 2000.P0343US
Replacement Sheet

35/36

Title: MULTI-SYSTEM PLUG-IN POWER RECEPTACLE FOR MODULAR POWER DISTRIBUTION SYSTEM
Inventor(s): Ross S. JOHNSON et al.
Serial No.: 11/165 148
Docket No.: 2000.P0343US
Replacement Sheet

36/36

MULTI-SYSTEM PLUG-IN POWER RECEPTACLE FOR MODULAR POWER DISTRIBUTION SYSTEM

FIELD OF THE INVENTION

The invention relates to a modular power distribution system and more particularly to a multi-system plug-in power receptacle for the power distribution system.

BACKGROUND OF THE INVENTION

In open office areas, conventional arrangements of wall panels are provided which subdivide a large open office area into smaller cubicles or work stations. Such wall panels comprise serially-connected panels that are joined end to end and thus, these wall panels have a modular construction. The work stations defined by the wall panels provide individual work areas and not only provide work surfaces and storage areas but also are supplied with power and communications outlets.

With respect to power distribution systems for such environments, wall panels typically include raceways therein which define spaces within the wall panels in which power cabling may be received. It is known to provide in such modular wall panels, conventional power distribution systems which extend thru the raceways and have electrical receptacles attached thereto. A typical power distribution system includes modular power distribution assemblies (herein PDA's) which comprise elongate lengths of cabling that define one or more electrical circuits and have power blocks on the opposite ends thereof having ports to allow access to such electrical circuits. The distribution system further includes plug-in receptacles which each include rearwardly-projecting terminal posts that are adapted to plug into the ports on the PDA to electrically connect the receptacle to a selected one of the circuits defined within the PDA. On the front face of the receptacle, appropriate groups of openings are provided in a conventional arrangement to accommodate a conventional electrical plug, which openings provide access to hot, neutral and ground contacts enclosed within the housing.

A number of different constructions for such power distribution systems are known wherein each of these systems typically includes receptacles having a construction corresponding to the PDA used within the system. The assignee of the present invention, Haworth, Inc., distributes a number of such power distribution systems for use within different wall panel product lines, wherein these different systems require specific tooling for each type of receptacle since each receptacle has a different construction relative to the receptacles of the other systems.

It is an object of the invention to provide a common receptacle construction which may be readily adapted in receptacles which each have different shapes and configurations but use common internal component parts and similar internal structures.

The invention therefore relates to a receptacle construction which is readily adaptable for use in multiple power distribution systems wherein a plurality of different receptacles are still provided. These receptacles use common internal components which components also permit ready adaptation and design of additional receptacle constructions while reducing tooling and design costs in developing additional receptacles.

The receptacle construction of the invention uses a plurality of contact strip assemblies which are confined within the interior of the receptacle housing. Each contact strip assembly generally uses common components in that such contact strip assemblies include elongate conductive contact strips that have a modular construction so that the length of such contact strips may be varied, for example, for duplex or triplex receptacles, merely by varying the modular length of the contact strip. Such contact strips are shaped so as to include spaced apart prong seats along the length thereof which open forwardly and align with respective openings in the receptacle face to permit the receipt of a respective prong of a conventional plug. Such contact strips are configured to either accept a flat blade of a conventional hot or neutral prong, or the more cylindrical ground prong.

The contact strips of the invention are connected to flexible intermediate conductors which electrically connect the contact strips to a respective terminal. The terminal fits into the post on the back face of the receptacle and are adapted to be removably plugged into a PDA for engagement with the PDA conductors.

The flexible intermediate conductor therefore permits the contact strip and terminal to be readily adapted and configured for different housing constructions which might have a first front-to-back depth in one receptacle construction and a greater or smaller front-to-back depth in another receptacle construction. Further, the receptacles may have slidable or movable exterior posts in which the terminals are seated for engagement with a PDA wherein the flexible intermediate conductor permits displacement of the terminals of the receptacle so that the receptacle may be selectively connected to a selected one of the multiple circuits defined within a PDA.

Additionally, the ground contact strip may be more rigidly connected to a terminal with the ground terminal being assembled in one of two stationary positions for connection to either a common ground or an isolated ground circuit within the PDA.

The receptacle construction of the invention provides distinct advantages over prior constructions wherein the prior art receptacles are designed independently from each other and do not make use of a readily adaptable component construction.

Other objects and purposes of the invention, and variations thereof, will be apparent upon reading the following specification and inspecting the accompanying drawings.

BRIEF DESCRIPTION OF DRAWINGS

FIG. 37 is an isometric view of a double quad-point terminal;

FIG. 38 is an end view of the double terminal;

FIG. 39 is a bottom view of the double terminal; and

FIG. 40 is a front view of the double terminal;

Figure 1:
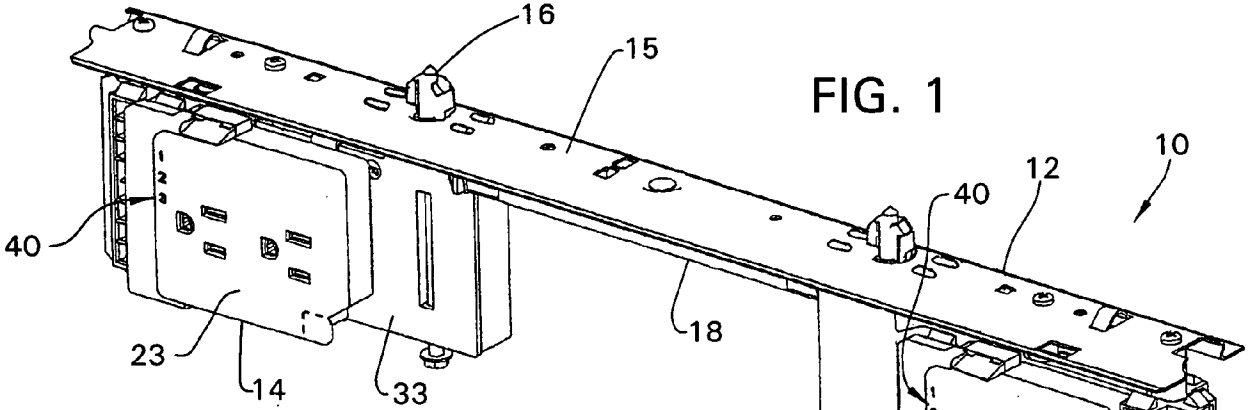
FIG. 1 is an isometric view of a power distribution system for office furniture such as wall panels comprising a power distribution assembly (PDA) and a receptacle at each end thereof.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
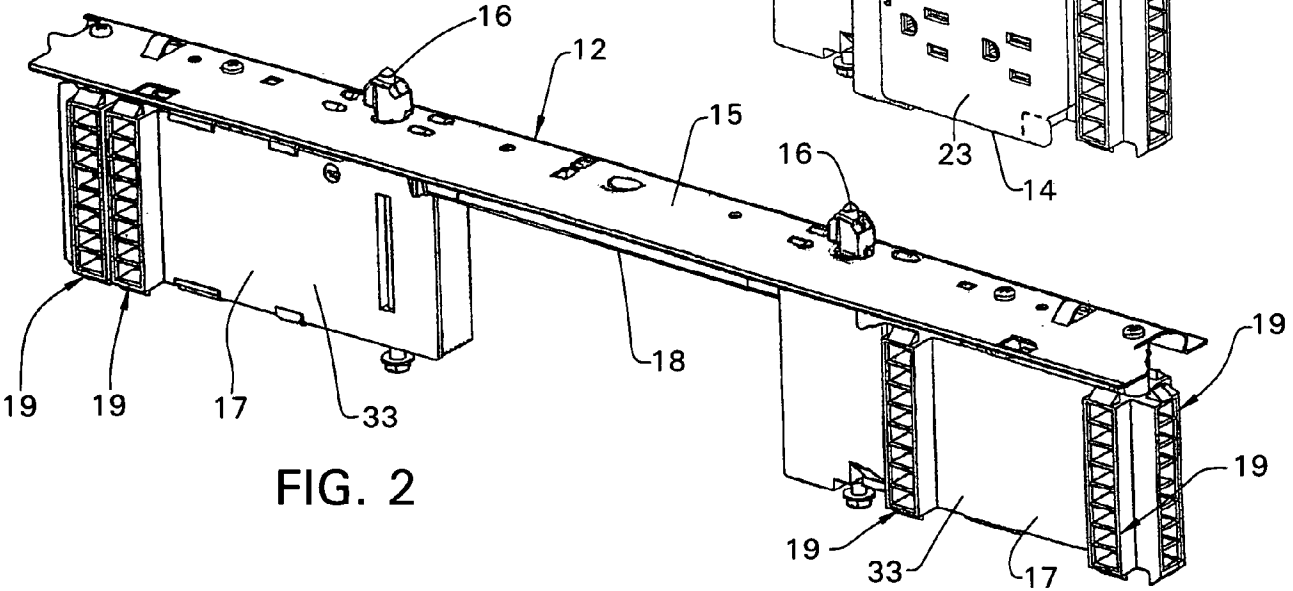
FIG. 2 is an isometric view of the PDA with the receptacles removed therefrom.

Referring to FIGS. 1–3, the invention relates to a power distribution system 10 which comprises a conventional power distribution assembly 12 (herein PDA) that is adapted to include demountable electrical receptacles 14. These receptacles 14 include an improved inventive construction relative to prior art receptacles previously used with the power distribution assembly 12.

Generally, power distribution systems of this general type have been known and examples of such systems are disclosed in U.S. Pat. No. 4,781,609 (Wilson et al.) and U.S. Pat. No. 5,595,495 (Johnson et al.), the disclosure of these two patents being incorporated herein in their entirety by reference. The systems generally disclosed in the '495 and '609 patents use power distribution assemblies or PDA's within the raceways of conventional wall panels and a detailed discussion as to the wall panels and their raceway constructions as well as the mounting of the power distribution assemblies therein is not required.

One known power distribution system of this general type includes the illustrated power distribution assembly 12 wherein the PDA 12 is of a conventional construction. The PDA 12 is disclosed in the present application for environmental purposes and the skilled artisan will readily appreciate that this PDA 12 is readily mountable within the raceway of a wall panel or other suitable locations within an open office area.

Generally as to the PDA 12 (FIGS. 1 and 2), this PDA 12 includes an upper mounting rail 15 having fasteners 16 projecting upwardly therefrom for engagement to the internal frame structure of the wall panel. The support rail 15 further supports a pair of power blocks 17 on the opposite end of the rail 15 which are electrically joined together by a conductor section 18 extending longitudinally therebetween. Each power block 17 has a conventional construction and encloses interior electrical contacts which contacts are connected to the individual conductor wires of the conductor section 18, wherein these interior conductors and contacts of the PDA 12 define a plurality of electrical circuits. These electrical circuits are defined by eight conductors which include a plurality of and preferably three pairs of hot and neutral conductors along with at least one ground conductor. Specifically, the PDA 12 preferably includes a conductor which defines a common ground and an additional conductor which defines an isolated ground for a total of eight conductors in a three-circuit PDA.

The power block 17 further includes groups of access ports 19 (FIG. 2) in the opposite faces of the power block 17. These groups of access ports 19 individually provide access to a respective one of the above-described conductors wherein the hot conductors, ground conductors and neutral conductors are readily accessible through the ports 19.

Normally, the PDAs 12 are provided in a plurality of serially-adjacent wall panels and are connected to each other by jumper cables of known construction which therefore allows the multiple power circuits to pass through the raceways of the office area. To then tap off from these electrical circuits and provide electrical outlets in individual work stations, known systems also include plug-in receptacles such as those disclosed in the '495 and '609 patents referenced above.

More particularly as to the power distribution system 10 of the invention, this system 10 includes the inventive receptacles 14 (FIGS. 1 and 3) which removably engage to the power blocks 17 at selected locations throughout the power distribution system 10. In particular, the receptacles 14 are readily adapted for engagement with the groups of access ports 19 by mechanical engagement of the receptacle 14 to the power block 17.

Figure 6:
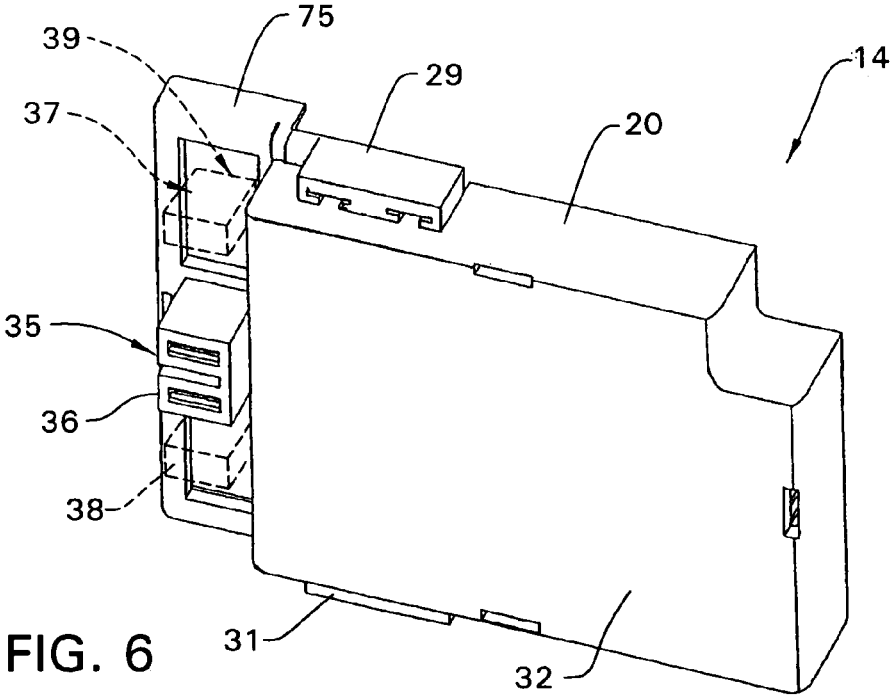
FIG. 6 is a back isometric view of the housing back as viewed from the rear thereof.

Referring to FIGS. 3 and 6, each receptacle 14 comprises a back housing 20 and a front housing 21 which said front and back housings 20 and 21 are joined together to define a hollow interior compartment 22 within the receptacle 14.

The front housing 21 includes a front wall 23, which, in the illustrated embodiment of FIG. 3, includes two groups of openings, i.e. outlets 24 such that the illustrated receptacle 14 is of a duplex receptacle type. The outlets 24 comprise groups of three standard shaped openings 25, 26 and 27 which are shaped to accommodate the hot, neutral and ground prongs of a conventional electrical plug such as an electrical plug on the power card of a computer, light, printer or any other powered equipment used in an office. The front housing 23 also includes a connector clip arrangement on the upper and lower edges thereof which is adapted to engage the receptacles 14 to a respective PDA 12 in removable engagement therewith.

Figure 3A:
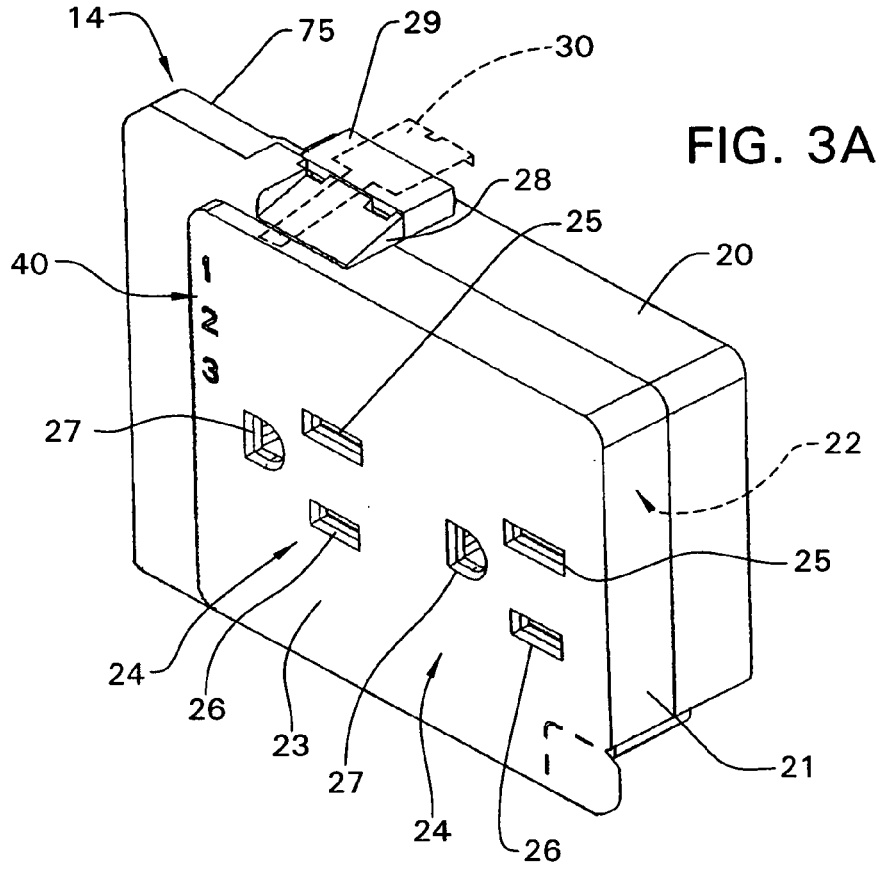
FIG. 3A is a front isometric view of a first embodiment of the receptacle.

Referring to FIGS. 3A and 6, the back housing 20 has a complimentary shape relative to the front housing 21 and has connector blocks 28 on the upper and lower edges thereof which are adapted to align with clip connectors 29 when the two housing halves are joined together and thereby support a resilient spring clip 30 therein. The clips 30 (FIGS. 3B–3D) are adapted to hook onto the PDA 12 but also are deflectable to unhook from the PDA and permit removal of the receptacle 14 by pulling it outwardly.

Figure 4:
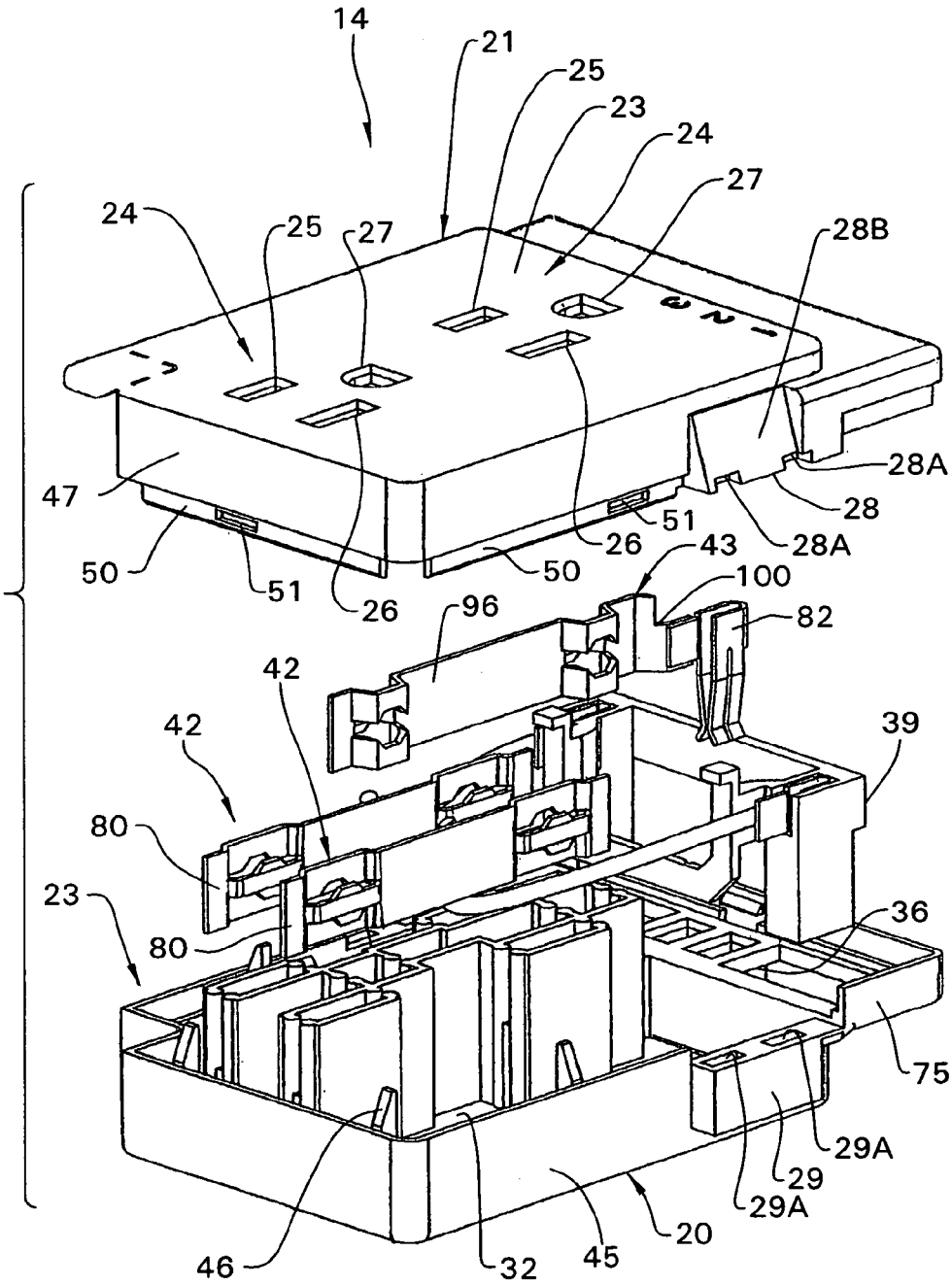
FIG. 4 is an exploded isometric view of the receptacle components.

Referring to FIG. 4, the connector block 29 has a pair of connector passages 29A extending therethrough which are adapted to receive barbed mounting portions of the clip 30. The other connector block 28 has a pair of clearance notches 28A and an inclined surface 28B which defines a clearance space for pivoting of the clip 30.

Figure 3D:
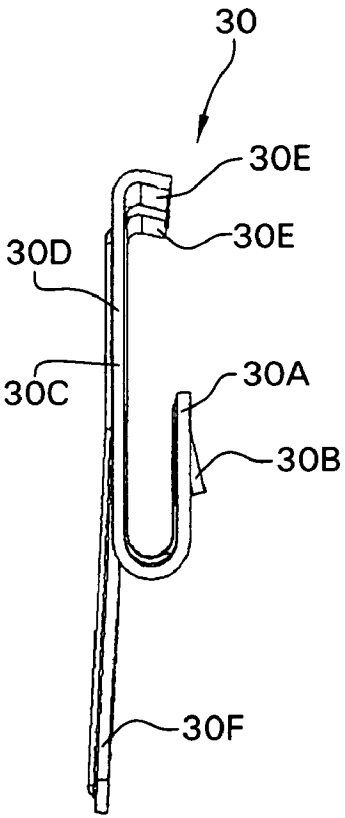
FIG. 3D is a side isometric view of the clip.
Figure 3C:
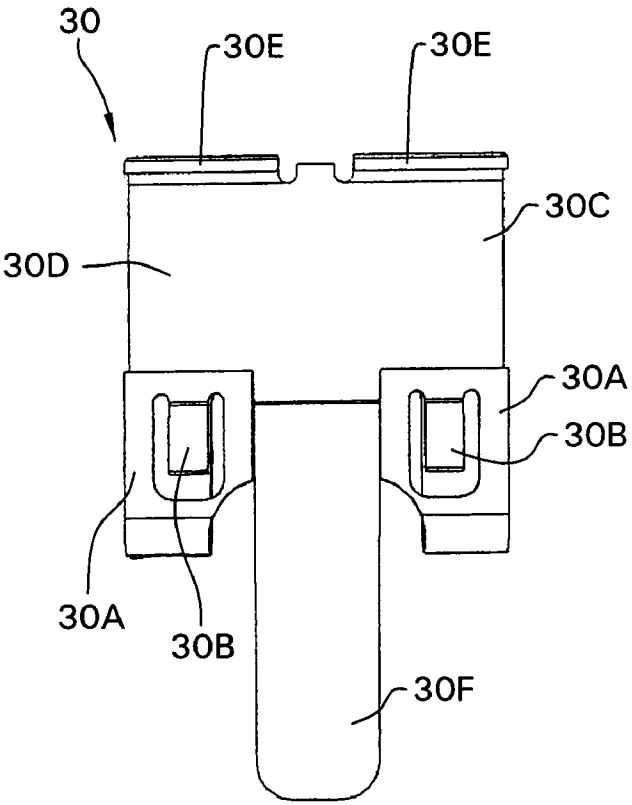
FIG. 3C is a facing view of the clip.
Figure 3B:
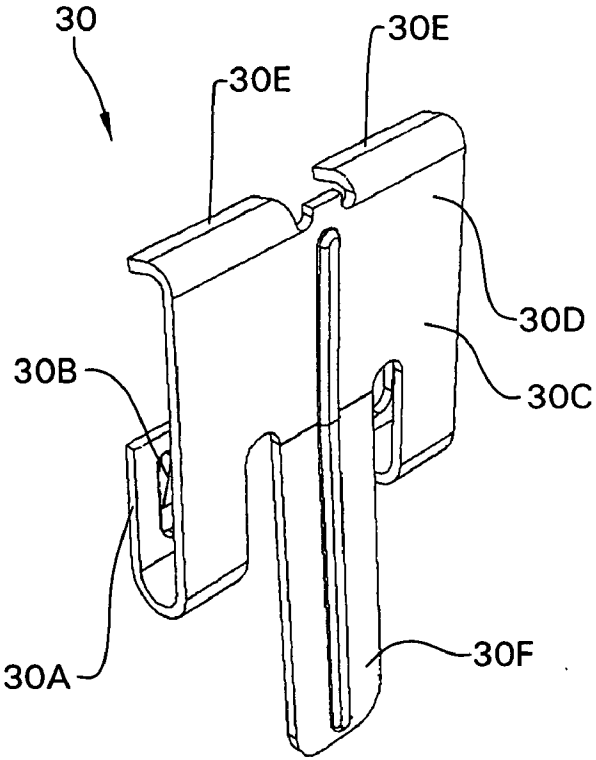
FIG. 3B is an isometric of a connector clip.

More particularly as to the clip 30 illustrated in FIGS. 3B–3D, each clip 30 is formed of resilient metal and includes a pair of barbed flanges 30A having barbs 30B which fit into the respective passages 29A. The flanges 30A support a J-shaped support arm 30C which extends in generally parallel relation with housing side walls 45. This support arm 30C curves outwardly and is formed in a one-piece configuration with a locking arm 30D. The clearance notches 28A allow the support arm 30C to be sandwiched between the opposed faces of the connector blocks 28 and 29.

The resiliency of the support arm 30C permits resilient pivoting of the lock arm 30D. The lock arm 30D has a hooked end 30E which is adapted to hook onto a PDA and further has a finger pad or lever 30F which may be pressed inwardly by the fingers of a user to pivot the hooked end 30E outwardly out of engagement with a PDA.

Figure 3F:
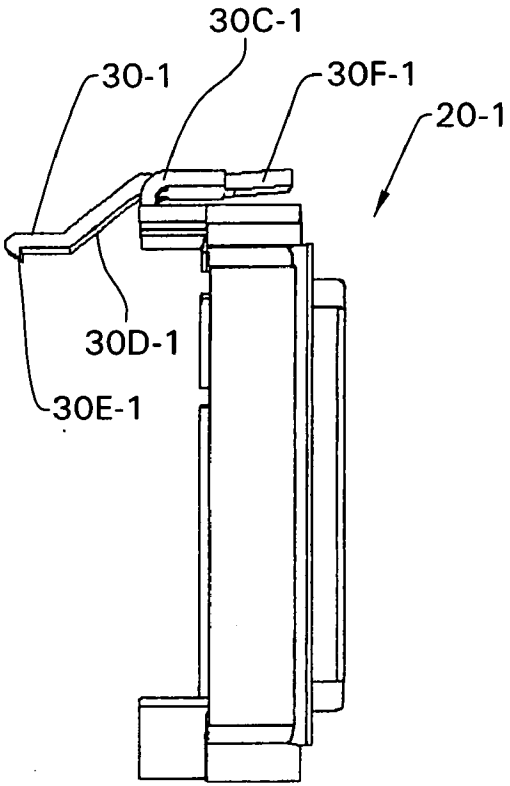
FIG. 3F is an end view of the housing of FIG. 3E.
Figure 3E:
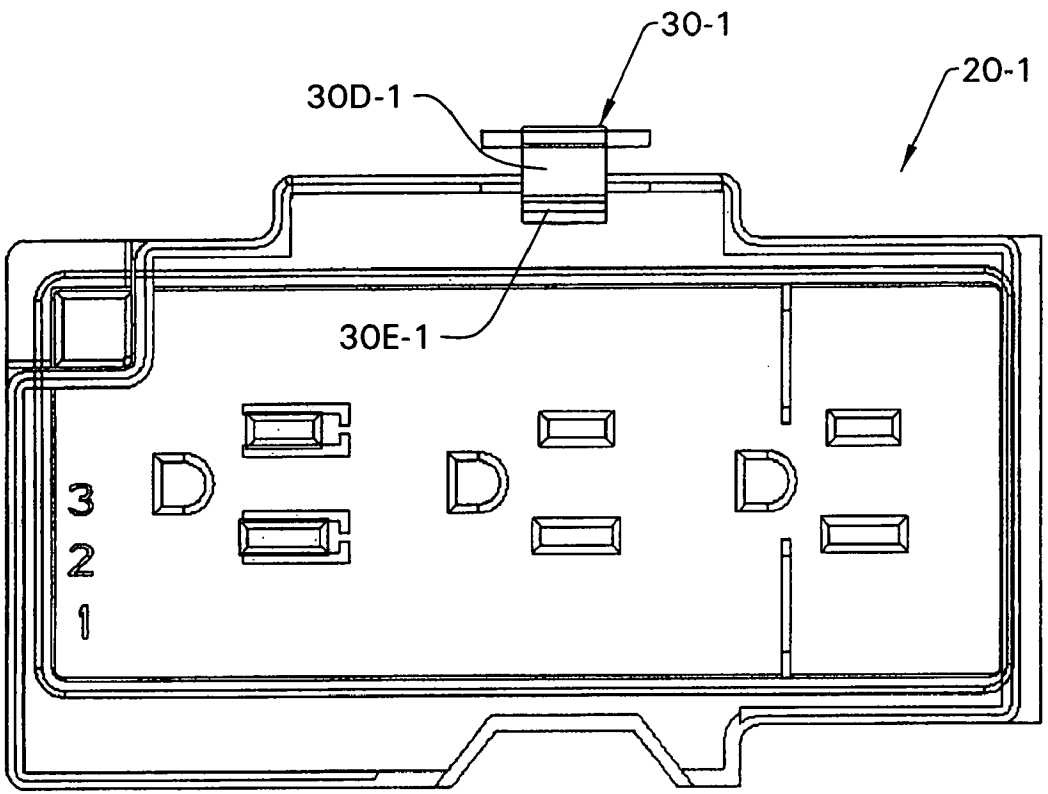
FIG. 3E is an inside view of an alternative receptacle housing having a molded clip construction.

Referring to FIGS. 3E and 3F, an alternate front housing 21-1 includes a clip 30-1 molded directly therewith. This clip 30-1 similarly includes a support arm 30C-1 and a lock arm 30D-1 wherein the hooked end 30E-1 is articulated by a finger pad or lever 30F-1.

The back housing 20 (FIGS. 5–7) further has a back wall 32 which is adapted to lie flat against a front face 33 of the PDA power blocks 17. To mount the receptacle 14 to the PDA 12, the receptacle 14 includes a plurality of insulated terminal posts 35–38 (FIG. 6) projecting from the back face. The two central posts 35 and 36 are stationary and shaped for respective engagement with the ports 19 corresponding to the isolated ground and the common ground conductors of the PDA 12. The additional outer posts 37 and 38 are formed as part of a monolithic slide block 39 (FIGS. 4 and 6) and are movable so as to be respectively engaged with any hot conductor and its associated neutral conductor of the PDA 12. Therefore, the pair of hot and neutral posts 37 and 38 are vertically slidable so as to selectively engage one of the three different electrical circuits defined within the PDA 12 wherein the relative position of the slide block 39 and the circuit thereby tapped off is identified by the numerical surface indicia 40 located in the front wall 23 of the front housing 21 (FIG. 3). A more detailed discussion of these individual components is provided hereinafter relative to FIGS. 4–11.

Referring to FIG. 4, the receptacle 14 is illustrated in an exploded view with the front housing 21 separated from the back housing 22 to expose the hollow interior 23. Referring to FIGS. 4–7, the receptacle 14 further includes a circuit contact strip assembly 42 for connection to each of the hot and neutral conductors of the PDA 12. Also, a further ground contact strip assembly 43 is provided in the location between the hot and neutral assemblies 42 which is adapted for engagement to one of the ground conductors of the PDA 12.

More particularly as to the back housing 20, this back housing 20 includes all of the support structures for supporting the contact strip assemblies 42 and 43. In particular, the back housing 20 includes the back wall 32 which is surrounded by the rear side walls 45 (FIGS. 5 and 7) that extend generally about the periphery of the back wall 32. The side walls further include upright alignment guides 46 which are adapted to insert within and cooperate with the side walls 47 of the front housing 21.

Figure 10:
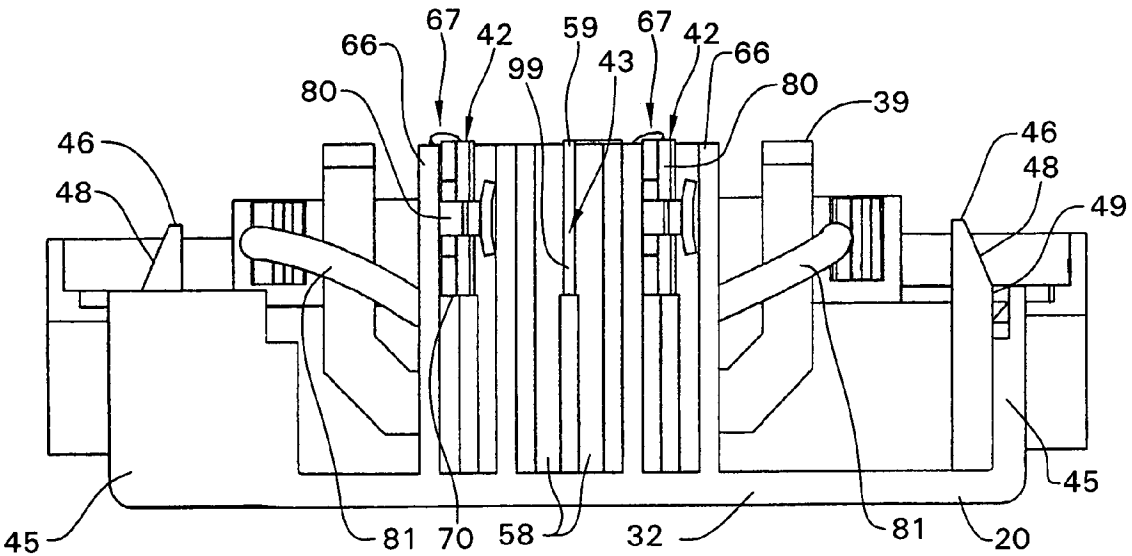
FIG. 10 is a cross-sectional view of the back housing assembly as taken long line 10—10 of FIG. 9.

As best seen in FIG. 10, the guide flange 46 has a tapered section 48 at the upper end thereof which serves to center the front housing 21 during engagement with the back housing 20. The guide flange 46 further includes an upright flat section 49 which defines the final alignment of the front and back housings 21 and 20 wherein the flat section 49 is in close abutting relation with the interior face of the front side wall 47.

Additionally, a stepped connector flange 50 (FIG. 4) is provided on the front side wall 47 which connector flange 50 extends edgewise and includes rectangular slots 51 (FIG. 4) that snap-fittingly engage with respective abutments 52 (FIG. 8) on the inside faces of the rear side walls 45. Therefore during assembly, the front and back housings 21 and 20 snap-fit together to enclose the hollow interior 23.

Figure 7:
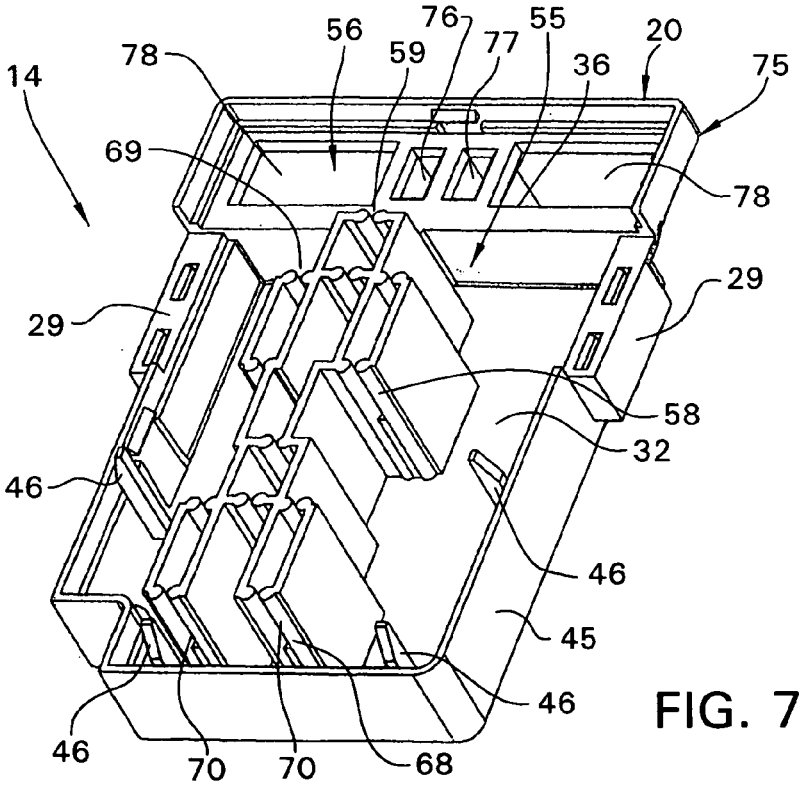
FIG. 7 is an isometric view of the back housing with the contact strip assembly removed therefrom.
Figure 8:
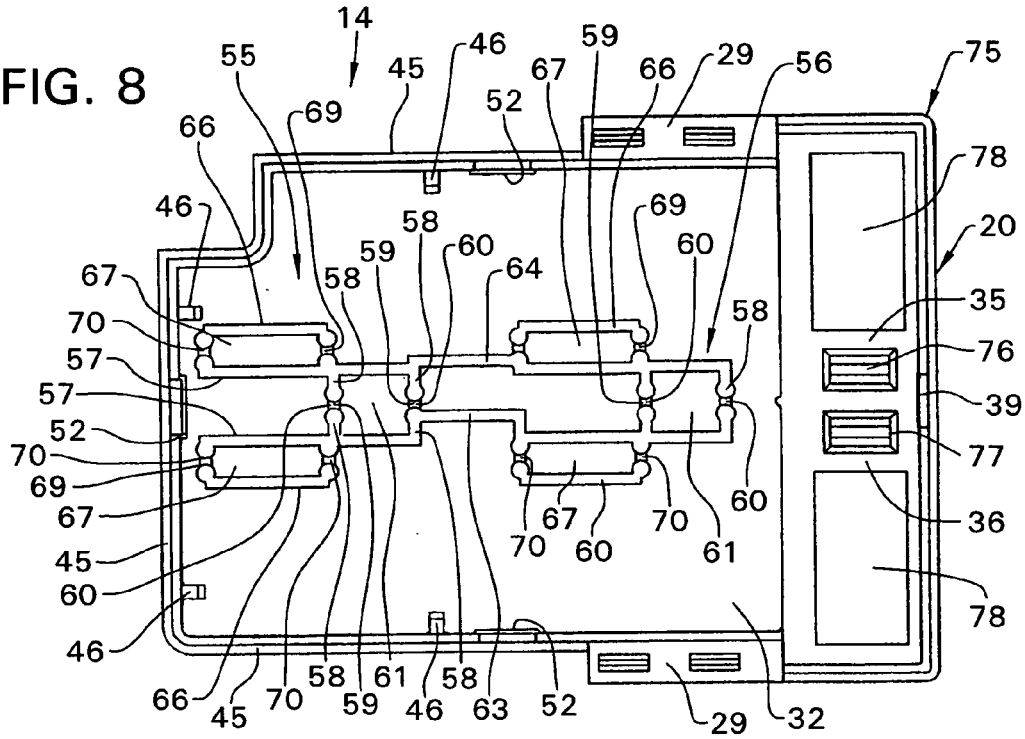
FIG. 8 is a plan view of the back housing of FIG. 7.

The receptacle 14 further includes column-like interior support projections 55 (FIGS. 4, 5 and 7) which generally project from one of the back and front housings 20 and 21 and in this embodiment, from the back housing 20. The support projections 55 support the contact strip assemblies 42 and 43 adjacent to the front wall 23 of the front housing 21, wherein the contact strip assemblies 42 and 43 are supported directly adjacent to the outlet openings 25, 26 and 27 such that insertion of the prongs of a conventional electrical plug through the openings 25–27 permits the prongs to be electrically engaged with the contact strip assemblies 42 and 43. Referring to FIGS. 7 and 8, these support projections 55 are defined by molded wall sections generally identified by reference numerals 56, which wall sections 56 project forwardly from the back wall 32 of the back housing 20.

More particularly referring to FIG. 8, the wall sections 56 comprise a pair of inner wall sections 57 which extend generally linearly and are generally parallel along much of the length thereof. The inner wall sections include a plurality of short segments 58 which project toward each other in pairs to define intermediate slots 59 therebetween and a shoulder 60 which is adapted to support a ground contact strip assembly 43 (FIG. 9) thereon. The short segment 58 essentially define a pair of columnar pockets 61 which open towards the front housing 21 and align with the ground openings 27 therein. The slots 59, shoulders 60 and pocket 61 generally conform to the shape of the ground contact strip assembly 43 to support same therein directly adjacent to the front wall 23 of the front housing 21.

The inner wall sections 57 also have stepped portions 63 and 64 (FIG. 8) which define spaces adjacent thereto, the function of which is discussed in further detail hereinafter.

The support projections 55 also comprise outer wall sections 66 which are spaced outwardly of the inner wall sections 57 to define a plurality of additional contact strip pockets 67 therein. The outer wall section 66 as well as the outer sides of the inner wall sections 57 all include short transverse segments 68 which are separated and opposing pairs by a contact strip slot 69 which define additional support shoulders 70.

The outer wall sections 66 differ from the inner wall sections 57 in that the outer wall sections 66 are sidewardly spaced apart from each other to define spaces laterally therebetween. The opposing inner wall sections 57, however, are continuous along the length thereof so as to electrically isolate the entire interior space in which the ground contact strip assembly 43 is positioned and electrically isolate same from the neutral and hot contact strip assemblies 42 that are supported on the outer wall sections 66.

Figure 5:
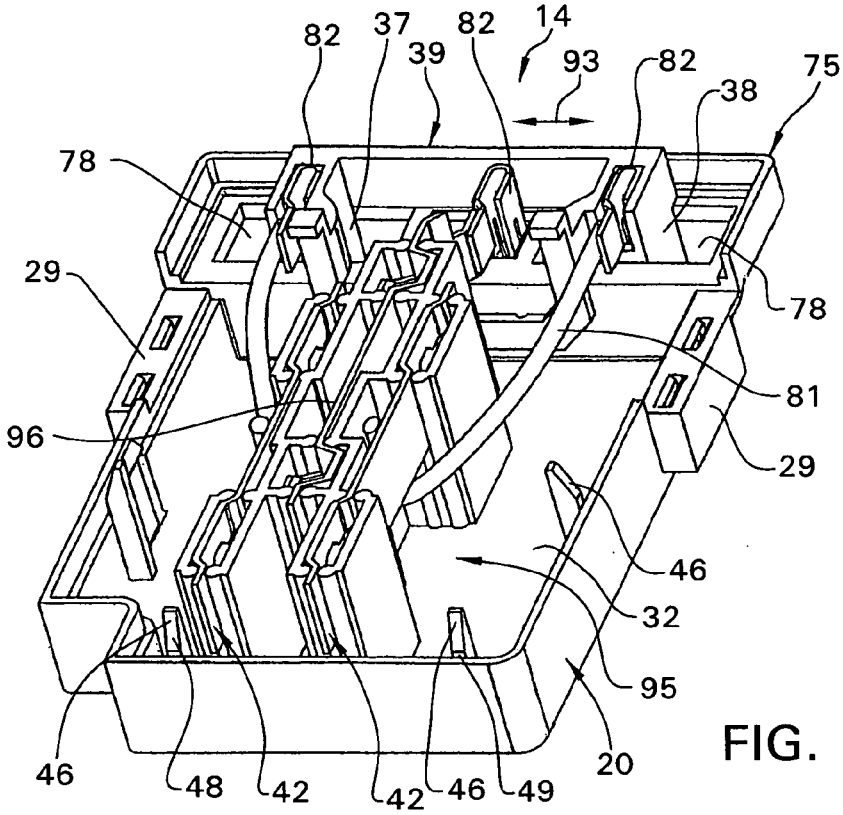
FIG. 5 is an isometric view of a back housing with a contact strip assembly mounted therein.
Figure 9:
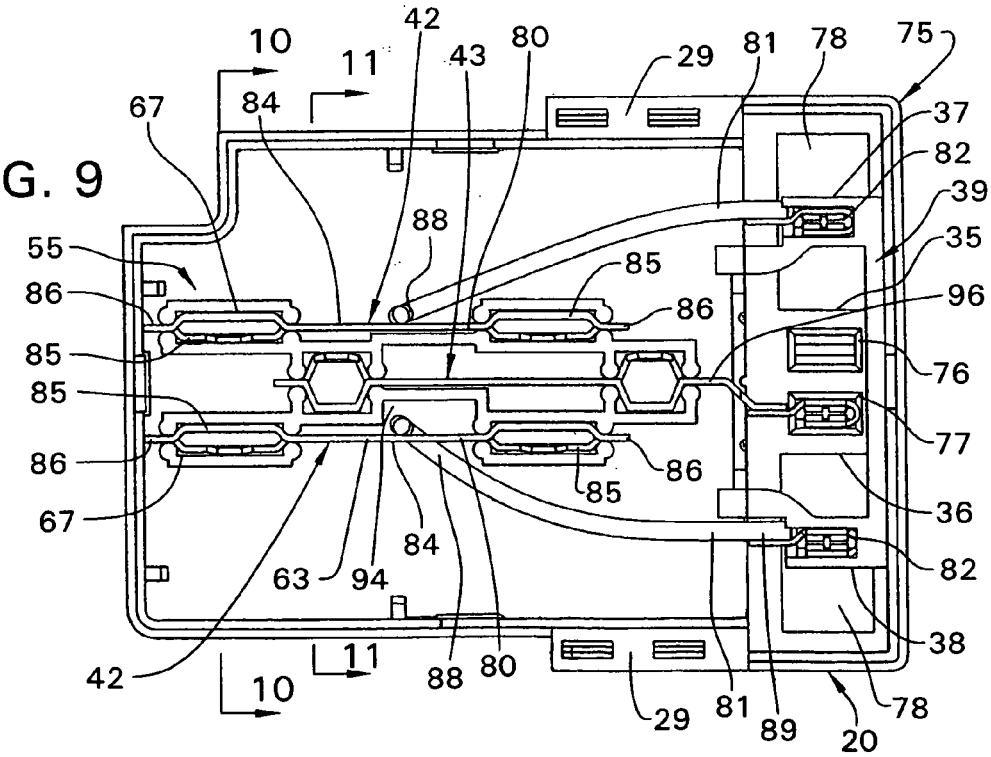
FIG. 9 is a plan view of the back housing and contact strip assembly of FIG. 5.

Additionally, the back housing 20 includes a shallower end portion 75 (FIGS. 7 and 8) which is adapted to slidably support the slide block 39 (FIGS. 5 and 9). The end portion 75 includes the posts 35 and 36 (FIGS. 6 and 8) which project rearwardly from a center portion thereof. These posts 35 and 36 include respective passages 76 and 77 opening centrally therethrough. These openings 76 and 77 are disposed in fixed positions and aligned for connection with respective openings 19 of the PDA 12 and specifically, the respective openings 19 which correspond to the common ground and isolated ground conductors disposed in the PDA 12.

Additionally, the shallow end portion 75 includes a pair of rectangular slide windows 78 (FIGS. 6 and 8) which slidably cooperate with the slide block 39 (FIGS. 5 and 9). Specifically, each of the terminal posts 37 and 38 of the slide block 39 is adapted to be slidably received within a respective one of the slide windows 78 as will be discussed in further detail herein.

Figure 12:
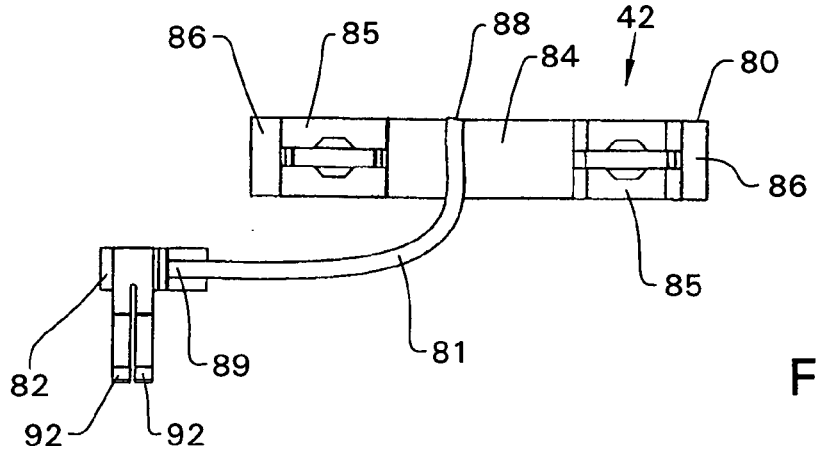
FIG. 12 is a front elevational view of the contact strip assembly for the first receptacle embodiment.
Figure 13:
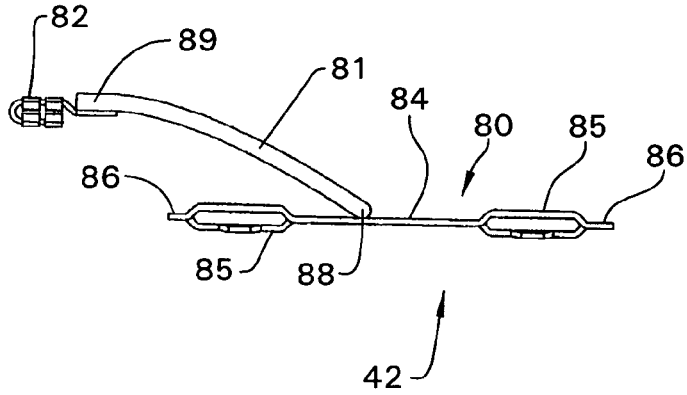
FIG. 13 is a plan view of the contact strip assembly.
Figure 14:
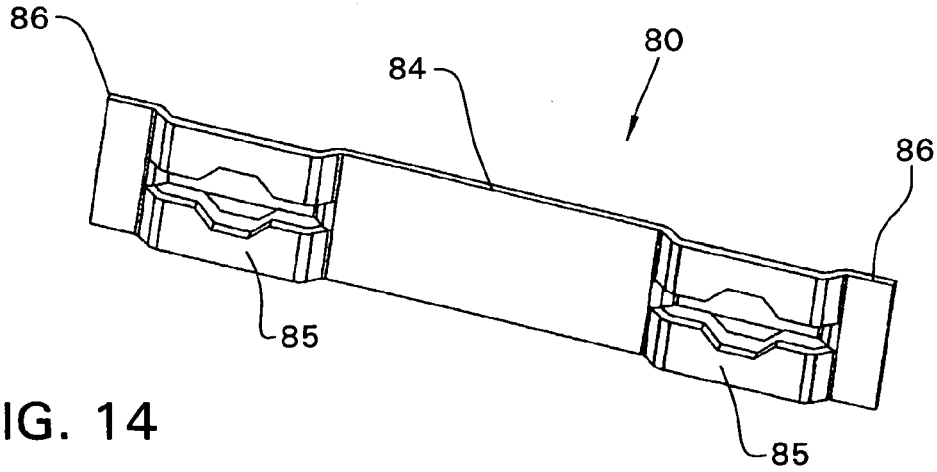
FIG. 14 is an isometric view of a contact strip.
Figure 16:
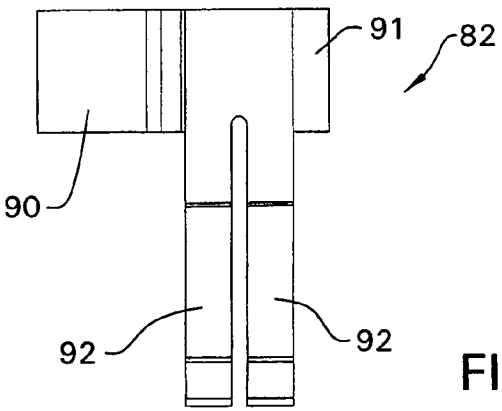
FIG. 16 is a front elevational view of the terminal.
Figure 18:
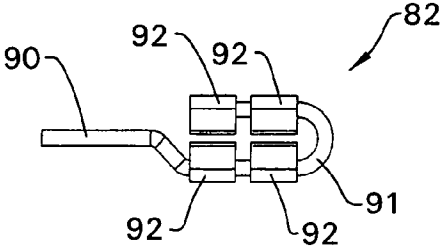
FIG. 18 is a bottom view of the terminal.
Figure 17:
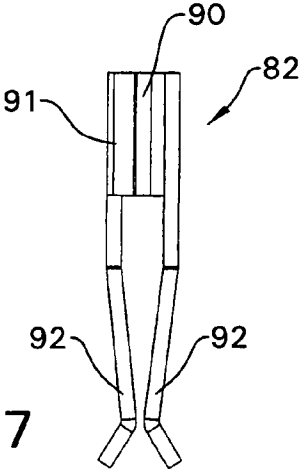
FIG. 17 is a left end view of the terminal.
Figure 15:
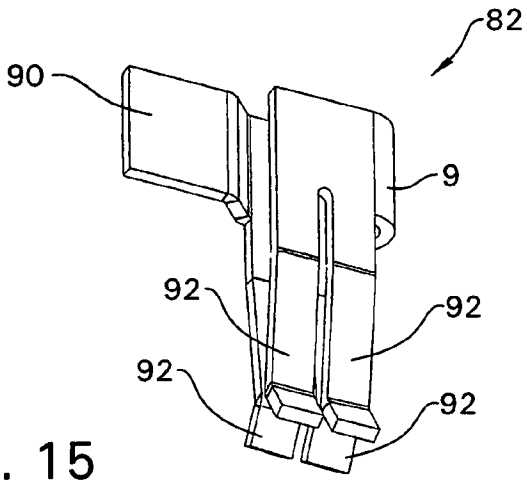
FIG. 15 is an isometric view of a quad-point terminal.

More particularly as to the contact strip assemblies 42 and 43, each contact strip assembly 42 is illustrated in FIGS. 12 and 13. This contact strip assembly 42 comprises a conductive contact strip 80, a flexible intermediate conductor 81 and a multi-prong or quad-point metal terminal 82. The contact strip 80 is formed in a duplex configuration and is formed from a strip of conductive metal such as brass. The contact strip 80 as illustrated in FIGS. 12–14 includes an intermediate web 84 which maintains the shape of the original material from which contact strip 80 is formed. The original stock material is mechanically formed at the opposite ends of the web 84 so as to include generally cylindrical prong sections 85 which are each adapted to tight fittingly receive a flat blade of a conventional electrical plug. The contact strip 80 is then terminated at the opposite ends so as to have end tabs 86 which are formed as a short variation of an intermediate web 84.

The contact strip 80 as well as all other strips disclosed herein may be formed by stamping or cut from a long length of coil stock.

The flexible conductor 81 in the illustrated embodiment is formed of a flexible wire which can be stranded or unstranded wire that is insulated or uninsulated. One end 88 of the flexible conductor 81 is electrically fastened to the web 84 by resistance welding or even by soldering. The opposite end 89 is also electrically connected to the terminal 82, again by resistance welding, soldering or the like.

With respect to the terminal 82 as illustrated in FIGS. 15–18, the terminal includes a connector tab 90 to which the end 89 of the flexible conductor 81 is connected. The terminal 82 is formed of a stamped conductive metal such as copper alloy and is shaped so as to have a U-shaped main body 91 which main body 91 supports a plurality and preferably four contact fingers 92 which project downwardly therefrom. The contact fingers 92 are adapted to fit over an electrical conductor of the PDA when the terminal 82 is slidably fitted into a respective PDA port 19. These contact fingers 92 are adapted to be slidably fitted into any of the rectangular openings which pass through the insulated posts 35–38 described above.

More particularly as to the contact strip assemblies 42 and their mounting in the housing sections 20 and 21, each of these contact strip assemblies 42 is supported adjacent to a respective one of the inner wall sections 57 of the housing support projections 55. Referring to FIGS. 5 and 9–11, the respective contact strip 80 is fitted into the support projections 55 with the prong support section 85 slidably fitted into the respective pocket 67. The web 84 and tabs 86 of each contact strip 80 extend through the slots 69 and are supported vertically on the shoulders 70 which define the bottom of the slot 69. The contact strips 80 thereby are supported at the upper ends of the inner and outer wall sections 57 and 66 respectively so that the upper edges of the contact strips 80 lie substantially flush or closely adjacent to the upper edges of the inner and outer wall sections 57 and 66 as seen in FIG. 5 as well as FIGS. 10 and 11. As such, these support projections 55 position the contact strips 80 closely adjacent and in substantially abutting relation with the interior face of the housing front wall 23. This aligns the prong slots 85 with the respective outlet openings 25 and 26 such that when the blades of an electrical plug are slid into the outlet openings 25 and 26, these blades are fitted into the prong slots 85 in electrical engagement therewith. Therefore, the contact strips 80 are located at an elevation which is directly adjacent to the front housing wall 23.

Figure 11:
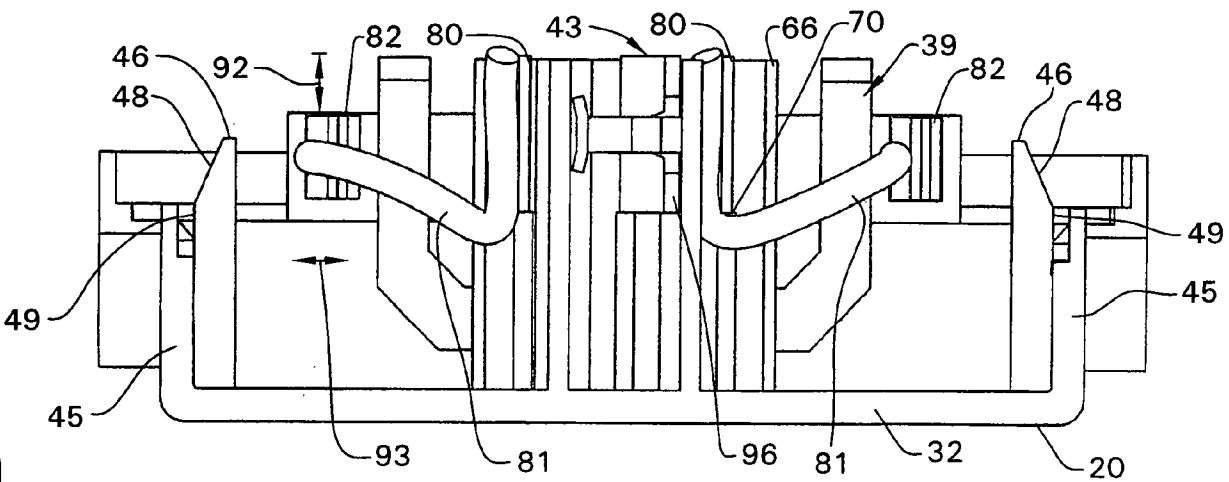
FIG. 11 is a cross-sectional view as taken along line 11—11 of FIG. 9.

The quad-point terminals 82 of the contact strip assemblies 42, however, are spaced interiorly or spaced away from the interior face of the front housing wall 23 as generally illustrated in FIGS. 10 and 11.

More particularly, the terminals 82 are slidably fitted into the openings of the respective insulated posts 37 and 38 as seen in FIGS. 5 and 9. The difference in elevation between the contact strip 80 and the respective terminal 82 is identified by reference arrow 92 in FIG. 11. Due to the flexibility of the intermediate conductor 81, the conductor 81 may be bent upwardly and downwardly (FIG. 11) to allow the contact strip 80 to be inserted into the pockets 67 while the terminals 82 may be independently slidably fitted into the posts 37 and 38. Additionally, this contact strip assembly 42 may be used in other types of receptacles which have a different elevational difference 92 as will be discussed in further detail herein. Furthermore, due to the flexibility of the intermediate conductor 81, this conductor 81 can readily accommodate sliding movement of the slide block 39 in the direction indicated by reference arrow 93 in FIG. 11. With the contact strip assemblies 42 positioned in place, these assemblies therefore are maintained in their seated position once the front housing 21 is mounted to the back housing 20 and as such, separate fasteners are not required to maintain the contact strip assembly 42 in place.

When mounted in position, it is also noted that the strip webs 84 are outwardly exposed as seen in FIG. 9. For one contact strip assembly 42, the conductor end 88 is exposed outwardly of the inner wall section 57. For the other, the step section 63 defines a space 94 (FIG. 9) in which the conductor end 88 may be accommodated while an additional vertical space 95 (FIG. 5) is formed therebelow to permit the intermediate conductor 81 to pass downwardly from between the strip pockets 67. Therefore, open spaces are provided between the strip pockets 67 to permit ready passage of the flexible conductors 81 outwardly therefrom.

Figure 19:
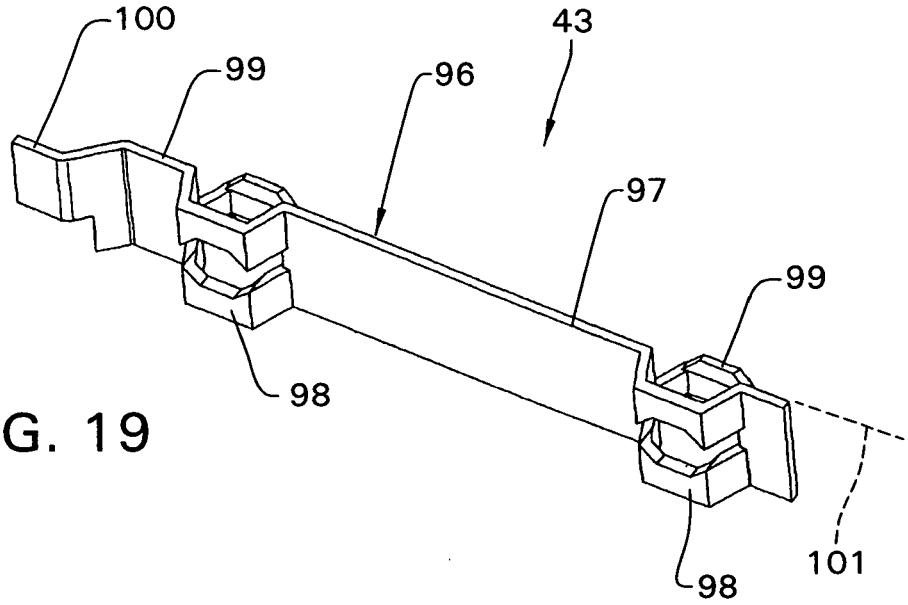
FIG. 19 is an isometric view of the grounding contact strip.
Figure 20:
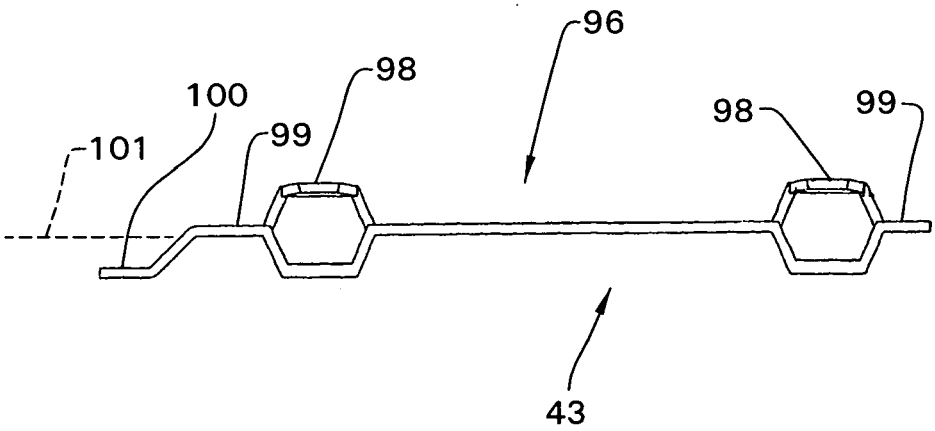
FIG. 20 is a plan view of the grounding contract strip.

More particularly as to the ground contact strip assembly 43, this contact strip assembly 43 includes a ground contact strip 96 as illustrated in FIGS. 19 and 20. This ground contact strip 96 includes an intermediate web 97 and is stamped to form a pair of prong slots 98 in the duplex configuration of FIGS. 19 and 20. The size of the prong slots 98 is larger so as to accommodate a conventional ground prong as compared to the blade slots 85 formed in the contact strip 80. The strip 96 further includes end tabs 99 wherein one of the end tabs 99 is shaped to define a connector flange 100. The connector flange 100 is offset sidewardly relative to the longitudinal central axis 101 of the contact strip 96. The connector flange 100 is adapted to have one of the terminals 82 affixed thereto such as by resistance welding or even soldering. The strip 96 may be oriented in the first orientation of FIG. 19 to allow the terminal 82 to be connected thereto and fitted into the insulated post 35 or the contact strip 96 may be rotated to the second position of FIG. 4 wherein the terminal 82 is aligned with the other insulated post 36 as seen in FIGS. 4 and 9.

The ground contact strip assembly 43 as seen in FIG. 4 therefore has a relatively rigid configuration in that the terminal 82 thereof is rigidly affixed to the contact strip 96 and is configured for either an isolated ground configuration or a common ground configuration with the contact strip assembly 43 being connected to one or the other of the isolated ground and common ground conductors when plugged into the PDA 12. When the ground contact strip assembly 43 is positioned in place, the web 97 and end tabs 99 extend through the slots 59 and rest on the shoulders 60 in a manner similar to the contact strips 80 discussed above. As such, the prong slots 98 are seated within their respective pockets 61 and aligned with the ground openings 27 of the outlets 24. Thus, depending upon the type of ground contact strip assembly 43 which is used, the receptacle 14 may be configured for connection to either the isolated ground or a common ground of the PDA 12.

Referring to FIG. 9, it is noted that the inner wall sections 57 extend continuously along substantially the entire length of the ground contact strip 96 so as to insulate and electrically isolate the ground strip 96 from the sidewardly adjacent contact strips 80 which correspond to the hot and neutral positions.

Based on the foregoing, the first receptacle construction illustrated in FIGS. 1–20 uses common parts for a first receptacle configuration.

Figure 21:
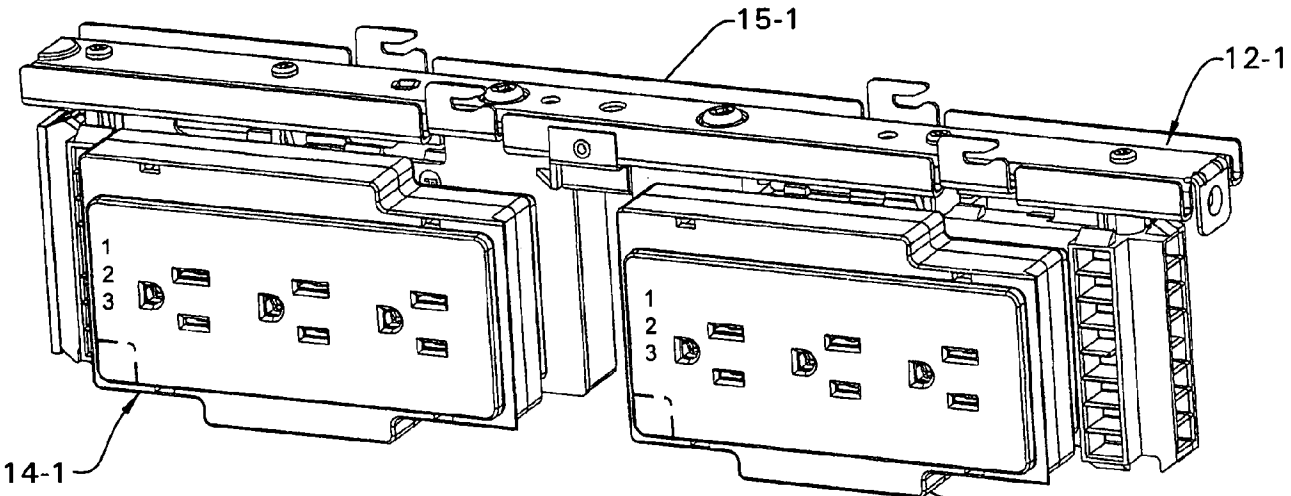
FIG. 21 is an isometric view of a second embodiment of a PDA with a second embodiment of a receptacle mounted thereto.
Figure 22:
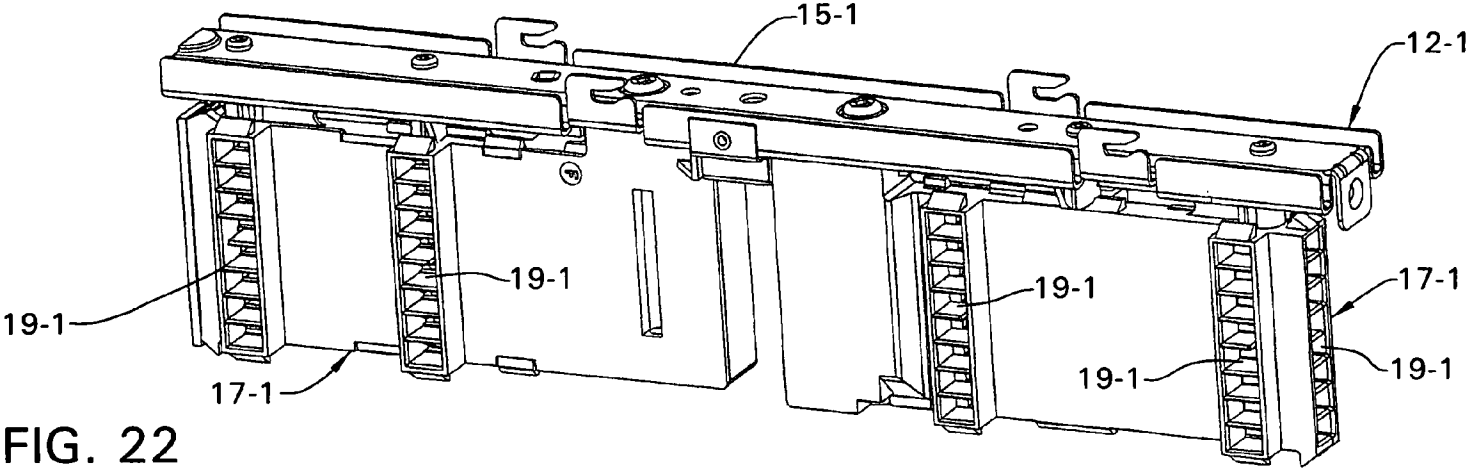
FIG. 22 is an isometric view of the PDA of FIG. 21.

A second receptacle configuration is illustrated in FIGS. 21–40. Referring to FIGS. 21 and 22, a second powered distribution system 105 is illustrated which comprises a PDA 12-1 and a plurality of demountable electrical receptacles 14-1.

The PDA 12-1 is formed substantially similar to the above-described PDA 12 except that it includes modifications as to the size and mounting structure, which modifications are not critical to the nature of the invention disclosed herein. The PDA 12-1 furthermore is similar in that it includes a mounting rail 15-1 on which is mounted a pair of power blocks 17-1. The power blocks 17-1 include groups of access ports 19-1 that provide access to a plurality of internal electrical conductors. These internal conductors define a plurality of circuits and preferably three circuits, each comprising a hot and neutral conductor, along with a common ground conductor and an isolated ground conductor. The arrangement of the conductors with respect to the access openings 19-1 is the same as described above relative to the power blocks 17 and thus, further discussion is not believed necessary. Further, the PDA 12-1 is a commercially available product from Haworth, Inc. the current Assignee of the present invention.

Figure 23:
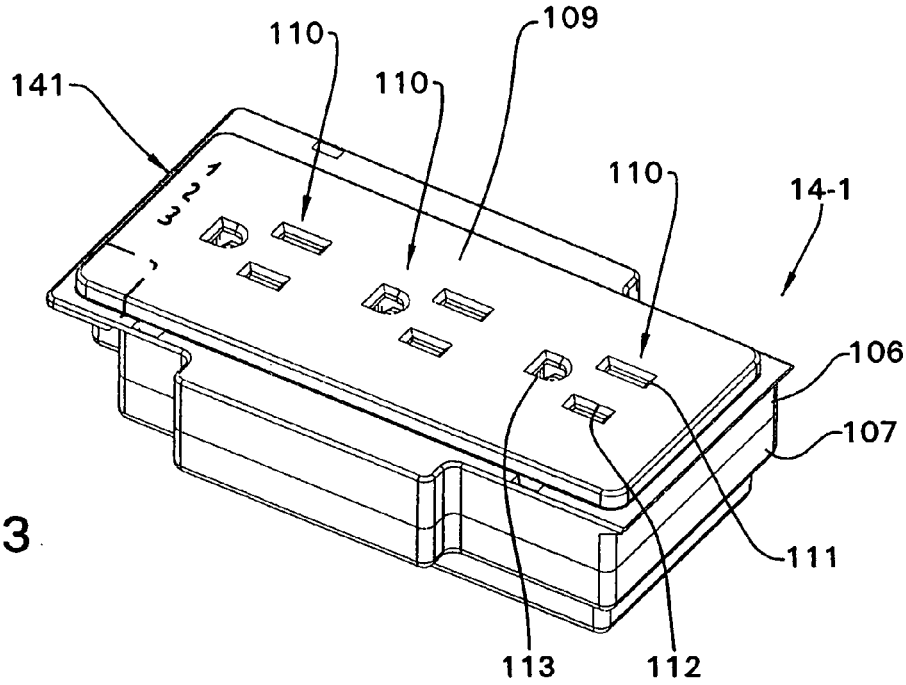
FIG. 23 is an isometric view of the second embodiment receptacle.

More particularly as to the receptacle 14-1 illustrated in FIG. 23, a receptacle 14-1 has a triplex configuration comprising a front housing 106 and a back housing 107 which are engaged together to define a hollow interior or compartment 108. It will be understood the receptacle 14-1 could be modified for a fourplex or fiveplex configuration. The front wall 109 of the front housing 106 includes three outlets 110 essentially defined by conventional groupings of openings 111, 112 and 113. The openings 111 and 112 are configured to accommodate the flat blades of a conventional electrical plug while the openings 113 are configured for a conventional grounding prong.

The overall housing construction defined by the front and back housings 106 and 107 is substantially similar to the receptacle housing construction of FIGS. 1–20 except it is noted that the depth of the receptacle as defined between the front housing 109 and a back housing wall 115 (FIG. 27) is greater than the depth of the receptacle 14. The receptacle 14-1 is designed for a different power distribution system 105 and in particular, is used with a different product line of wall panels sold by the assignee of the present invention. As such, the overall shape and dimensions of the receptacle 14-1 differ in many respects from the shape and configuration of the receptacle 14. However, the present invention is readily adapted to the design of the receptacle 14-1 while using a substantially similar internal arrangement of contact strip assemblies as will be described in further detail herein.

Figure 29:
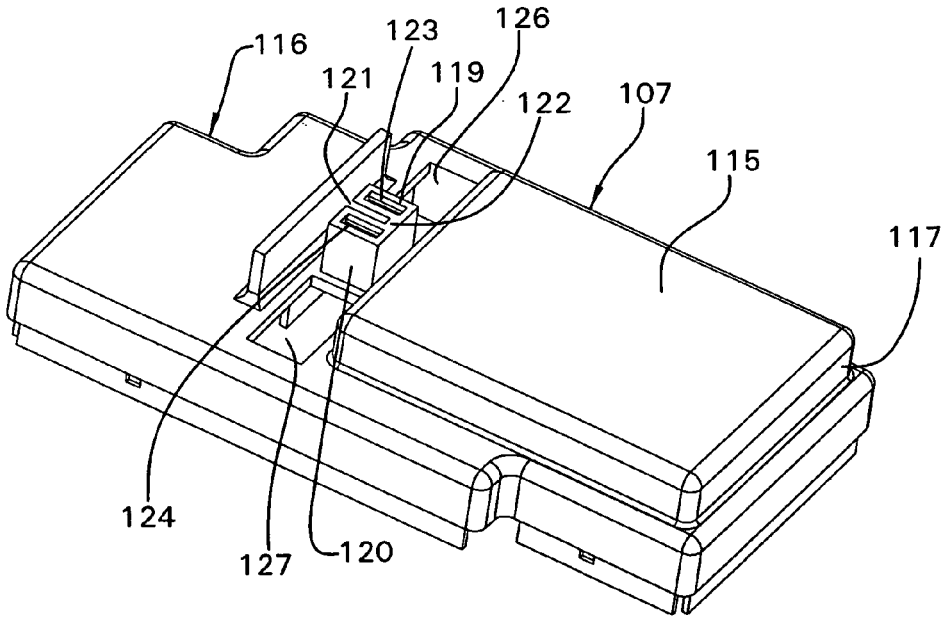
FIG. 29 is a back isometric view of the back face of the back housing.
Figure 30:
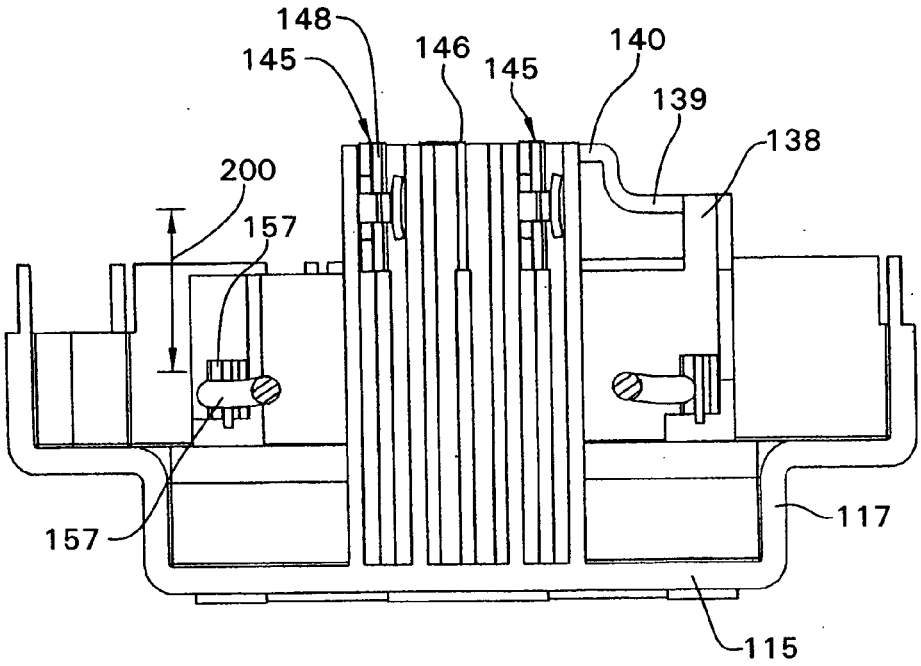
FIG. 30 is a cross-sectional end view of the back housing assembly as taken along line 30—30 of FIG. 26.

As to the back housing 107, this back housing 107 as seen in FIG. 29 has a shallow end section 116 as compared to the thickness of the back housing 107 in the region of the back housing wall 115. The back housing wall 115 is supported by a peripheral wall 117 to offset the back housing wall 115 rearwardly of the shallow section 116. Adjacent to the wall 117, the back housing 107 includes rearwardly projecting posts 119 and 120 (FIG. 29) which are located sidewardly adjacent to each other and separated by a slot 121 except for a connecting portion 122. Each ground post 119 and 120 has a passage 123 and 124 extending therethrough. These posts 119 and 120 are formed substantially similar to the above-described posts 35 and 36 in the receptacle 14.

Figure 24:
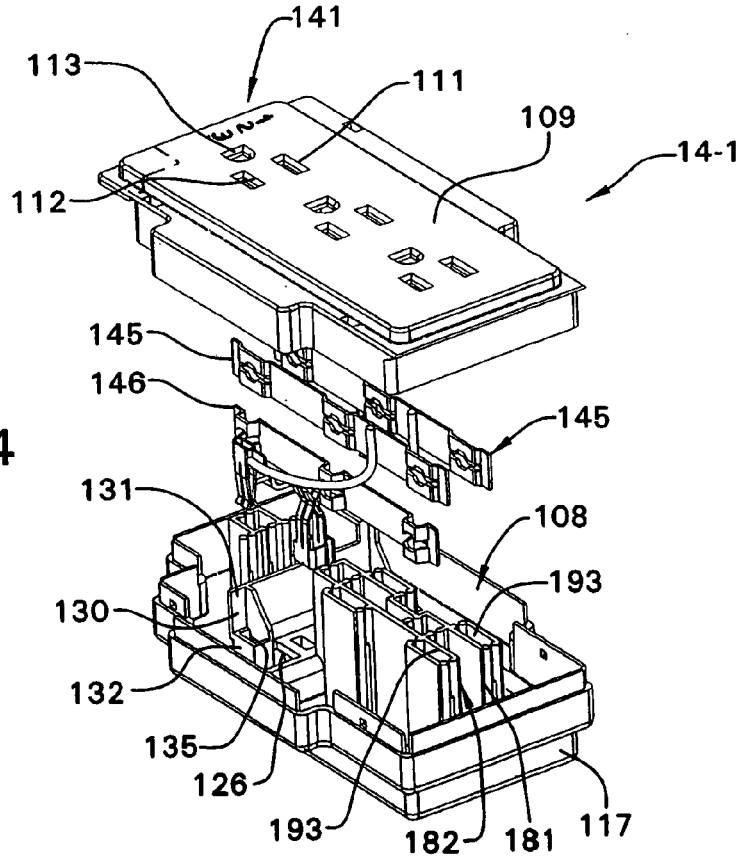
FIG. 24 is an exploded isometric view of the receptacle.
Figure 25:
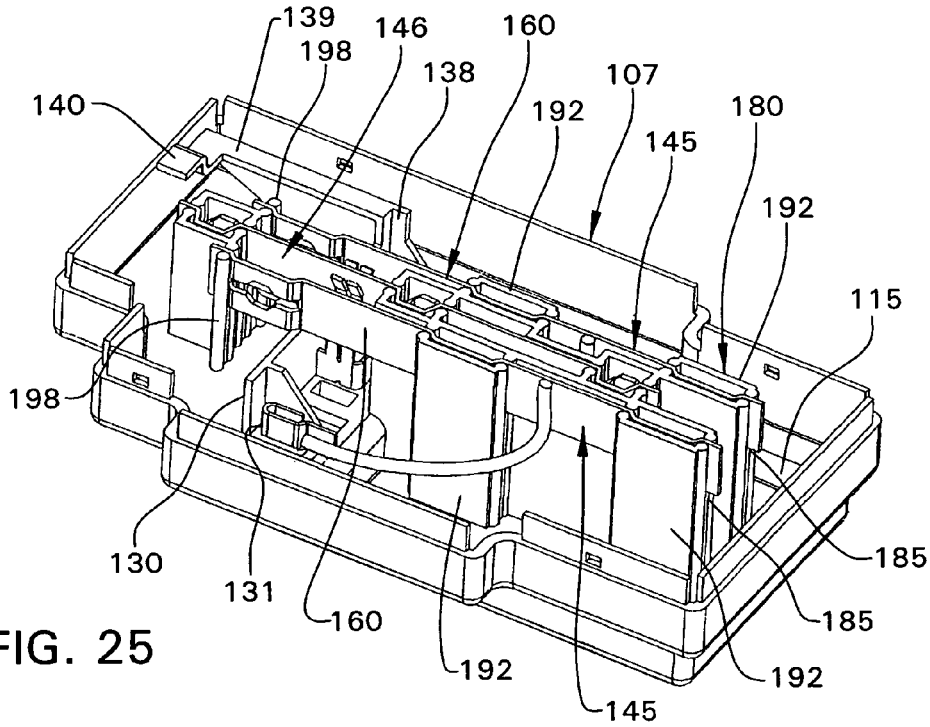
FIG. 25 is an isometric view of a back housing assembly.
Figure 26:
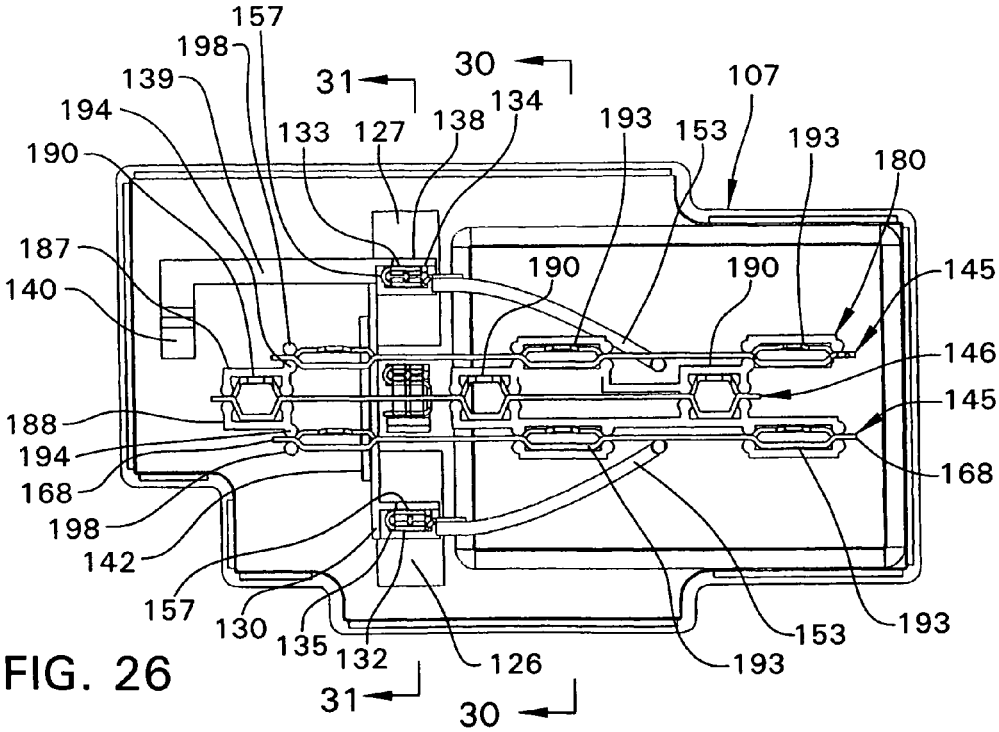
FIG. 26 is a plan view of the back housing assembly.
Figure 31:
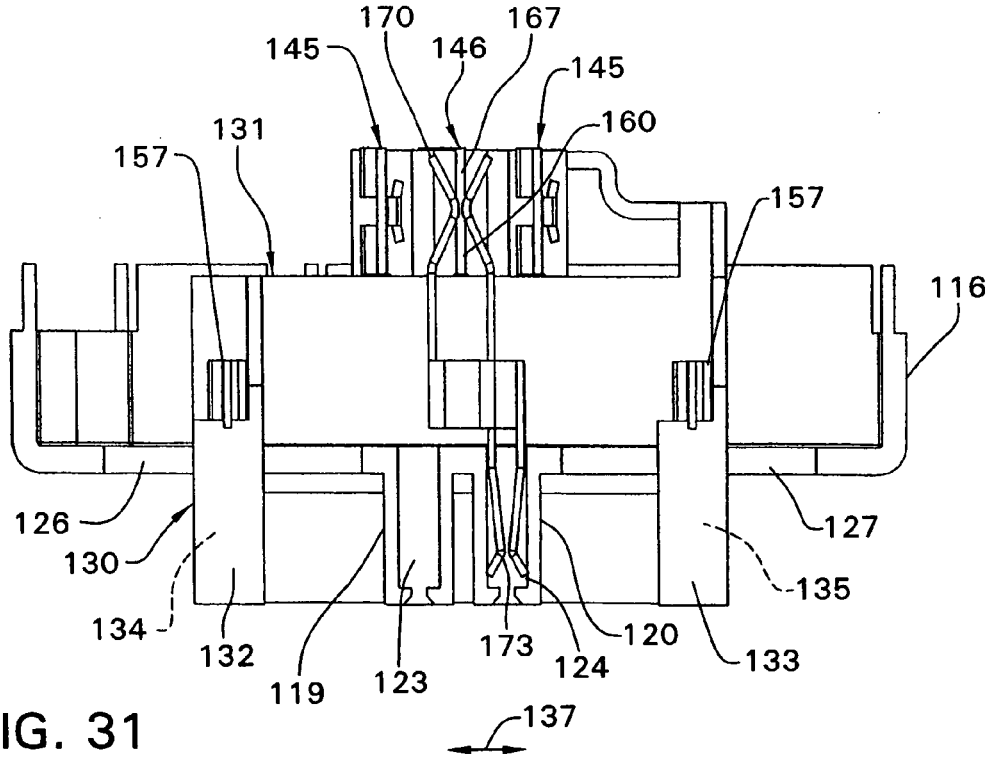
FIG. 31 is an end cross-sectional view as taken along line 31—31 of FIG. 26.

Additionally, pair of slide windows 126 and 127 (FIGS. 26 and 27) are formed to accommodate a slide block 130 (FIGS. 24-26). The slide block 130 performs substantially the same function as the slide block 39 discussed above although the exterior shape and configuration differ somewhat. The slide block 130 includes a main body 131 which supports insulated posts 132 and 133 which each have a generally rectangular shape and have a respective central passage 134 or 135 (FIG. 26) extending therethrough. The posts 132 and 133 project through the respective slide windows 126 and 127 and are slidable there along in the direction indicated by reference arrow 137 (FIG. 31). The slide block 130 further includes a support flange 138 at one end thereof having a cantilevered marker arm 139 which projects longitudinally and is stepped at the free end thereof to define a marker block 140. The marker block 140 slides closely against the inside face of the front housing wall 109 adjacent to numerical windows 141 to serve as surface indicia and indicate the specific one of the three internal circuits of the PDA 12-1 which are being tapped off by the receptacle 14-1. The back housing wall 115 further includes an upstanding guide flange 142 which abuts against an opposing face of the block body 131 to support the slide block 130.

Similar to the receptacle 14, the receptacle 14-1 further includes hot and neutral or circuit contact strip assemblies 145 and a ground contact strip assembly 146 positioned centrally between the circuit contact strip assemblies 145.

Figure 32:
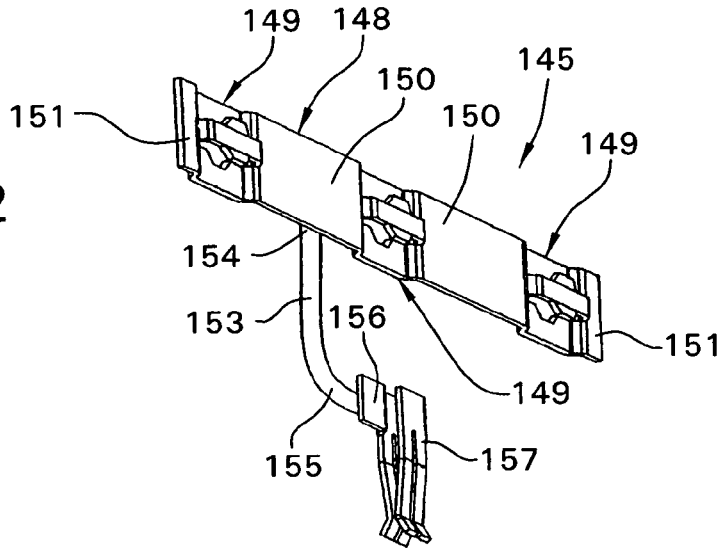
FIG. 32 is an isometric view of a triplex contact assembly.
Figure 33:
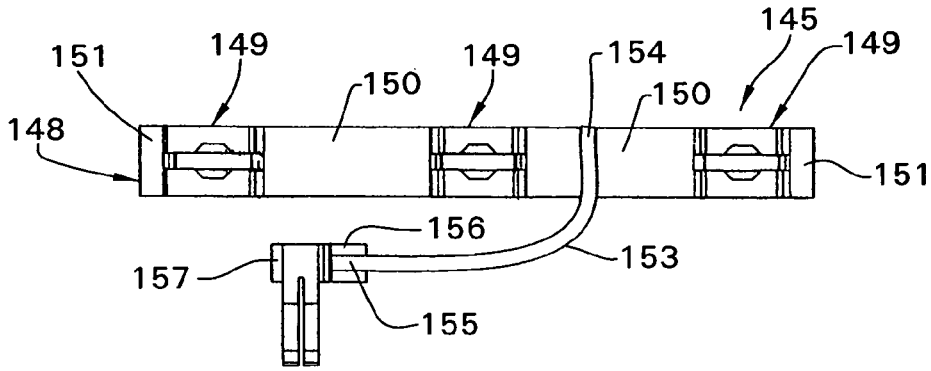
FIG. 33 is an elevational view of the triplex contact assembly.
Figure 34:
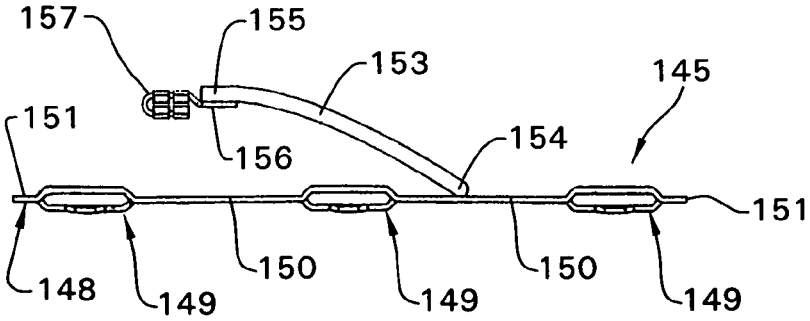
FIG. 34 is a plan view of the triplex contact strip assembly.
Figure 35:
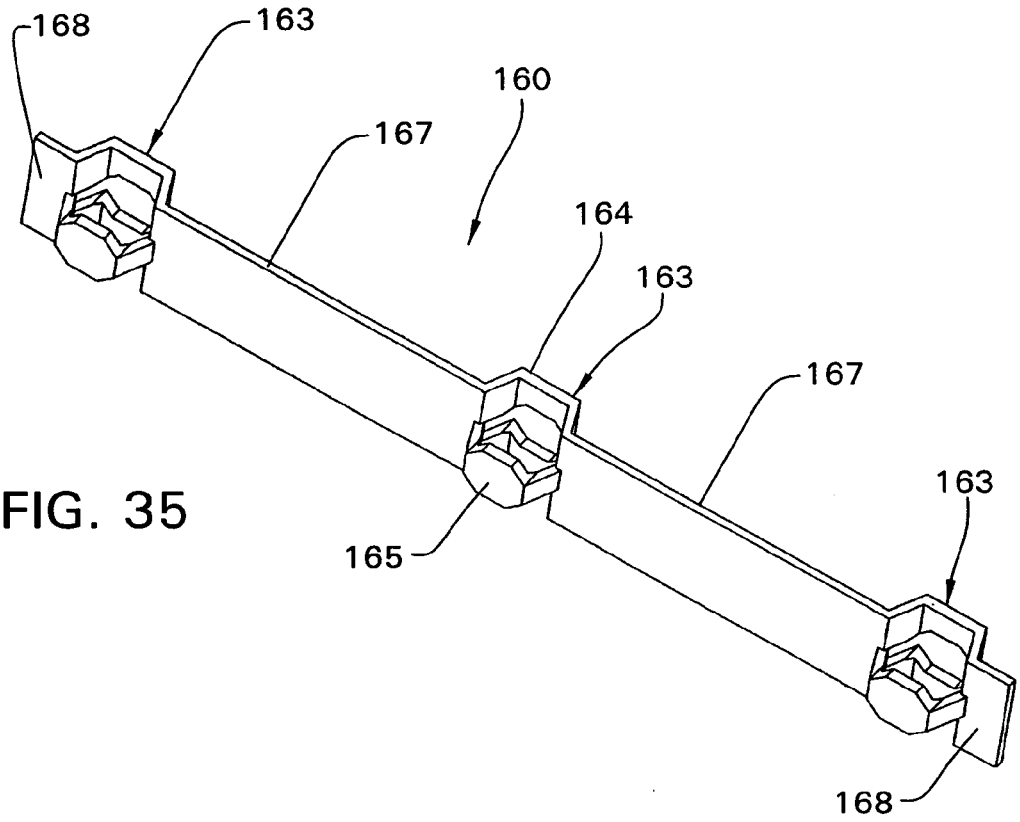
FIG. 35 is an isometric view of a triplex contact strip.
Figure 36:
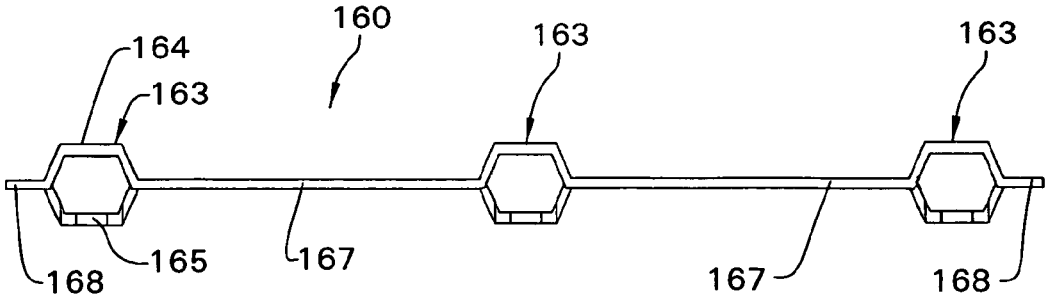
FIG. 36 is a plan view of the triplex contact strip.

Referring to FIGS. 32–34, the contact strip assemblies 145 include an elongate contact strip 148 formed of a ribbon of conductive metal, preferably brass. The contact strip is formed in a triplex configuration having a plurality and preferably three blade slots 149 stamped therein which are separated from each other by intermediate webs 150. The opposite ends of the contact strip 148 have end tabs 151. It will be understood that the contact strip 148 could be modified in other incremental configurations such duplex, fourplex, fiveplex, etc.

Each contract strip assembly 145 further includes a flexible intermediate conductor 153 having one end 154 soldered to a respective web 150 and an opposite free end 155 soldered to the connector flange 156 of a quad-point terminal 157. The terminal 157 is formed identical to the terminal 82 illustrated in FIGS. 15–18. Hence, further discussion of this terminal 157 is not required herein.

Essentially, the contact strip assembly 145 is formed substantially the same as the contact strip assembly 42 except that it is cut off so that it has a longer length for a triplex configuration, although it may be lengthened for fourplex or triplex configurations or shortened for a duplex configuration. The conductor 153 is flexible and bendable to adjust the relative sideward position of the terminal 157 relative to the contact strip 148 as well as the spacing upwardly and downwardly between the terminal 157 and the strip 148.

As to the ground contact strip assembly 146, this ground contact strip assembly 146 includes a contact strip 160 (FIGS. 35 and 36) and a bi-directional terminal 161 (FIGS. 37–40).

The contact strip 160 (FIGS. 35 and 36) is formed substantially the same as the above-described ground contact strip 43 except that it has a triplex configuration. More particularly, the contact strip 160 is stamped during its manufacture so as to have three ground prong slots 163 which are adapted to receive a generally cylindrical ground prong of a conventional electrical plug in tight fitting engagement therewith. The slots 163 include a main sidewall 164 and a band of stamped material 165 which defines the opposite sidewall thereof so as to define an octagonal wall portion. The shape and formation of these sidewalls 164 and 165 are substantially the same as the other prong slots provided in the above-described contact strips with it being understood that a prong slot adapted for a ground prong requires a larger size than a blade slot for a hot or neutral blade of an electrical plug. The prong slots 163 are separated from each other by intermediate webs 167 with end tabs 168 being provided at the opposite ends thereof.

Referring to FIGS. 37–40, the terminal 161 is formed of a conductive metal such as copper alloy that is stamped into the final configuration illustrated herein. The terminal 161 includes a plurality and preferably four prongs 170 which project in a first direction and are resiliently deflectable away from each other and define an intermediate conductor-receiving slot 171. The fingers 170 are joined together by a terminal body 172 which terminal body 172 has an S-shape as seen in FIG. 39. The terminal body 172 also supports four additional contact fingers 173 which project in a second direction opposite to the first direction such that the terminal 161 is a bi-directional terminal. Each set of fingers 170 or 173 effectively defines a quad-point finger construction with the fingers 173 defining a conductor-receiving slot 174 therebetween.

More particularly as to the assembly of the contact strip assemblies 145 and 146 with the front and back housings 106 and 107, it will be understood that these contact strip assemblies 145 and 146 are supported in a substantially similar manner to the contact strip assemblies 42 and 43 discussed above relative to FIGS. 1–20. In particular, the contact strip assemblies 145 and 146 are supported within support projections 180 (FIG. 27) formed in the back housing 107 wherein the support projections 180 vertically support the contact strips 148 and 160 closely adjacent to the interior face of the housing front wall 109, and in particular, closely adjacent and in alignment with the outlet openings 111, 112 and 113.

Figure 27:
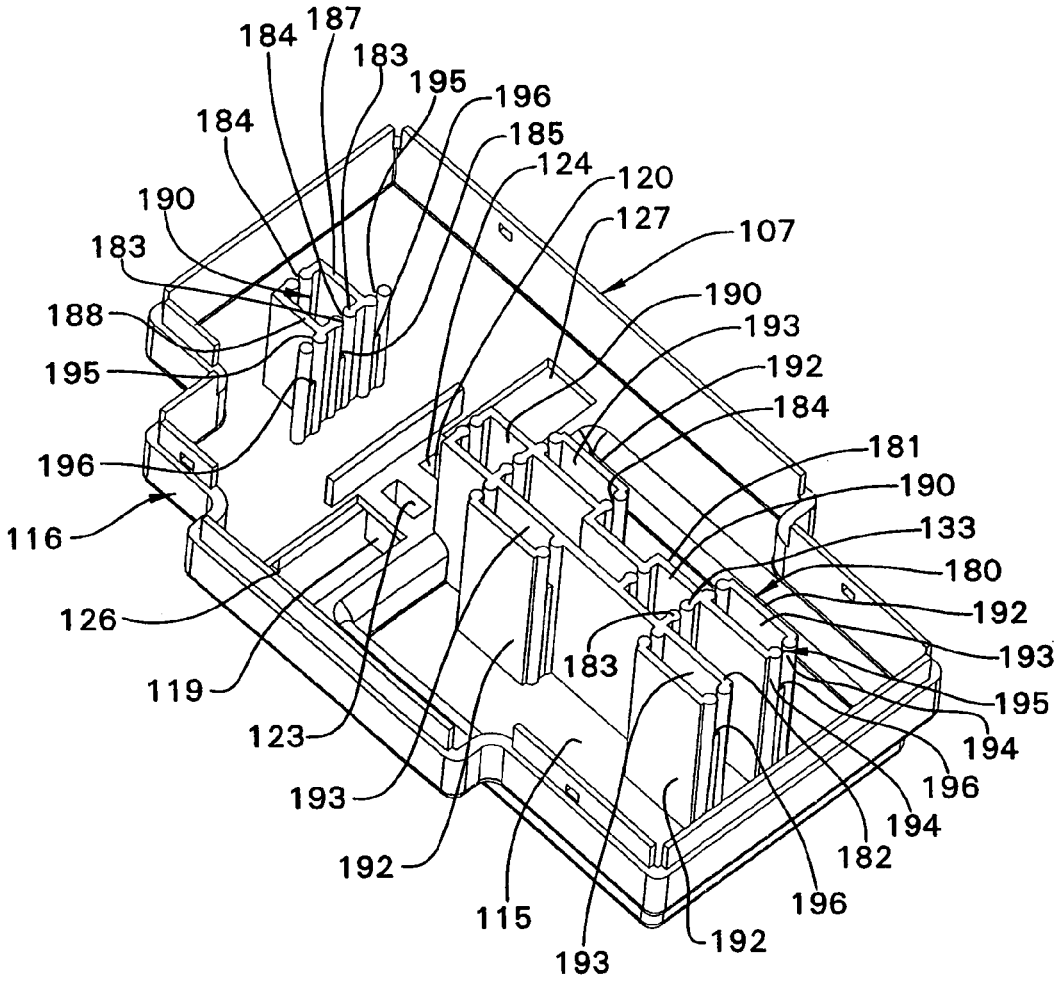
FIG. 27 is an isometric view of the back housing with the contact strip assembly removed therefrom.

More particularly as to the support projections 180, these projections 180 are illustrated in further detail in FIG. 27. In this regard, the support projections 180 comprise a pair of inner walls 181 and 182 (FIGS. 24 and 27) which extend across the back housing wall 115 up to the region of the slide windows 126 and 127. The inner wall sections 181 and 182 include transverse wall segments 183 which project toward each other in opposing pairs to define intermediate slots 184 therebetween which slots 184 extend downwardly and terminate at support ledge 185 (FIGS. 25 and 27).

Figure 28:
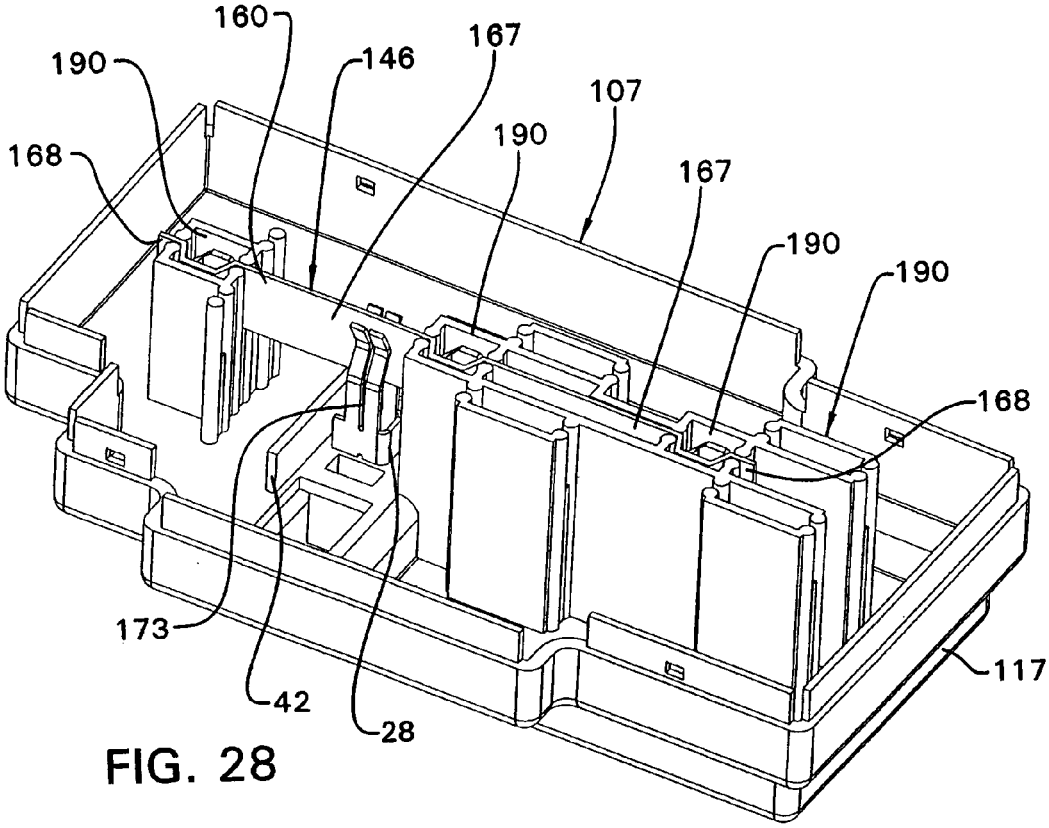
FIG. 28 is an isometric view of the back housing with a ground strip assembly mounted therein.

Additionally, secondary inner wall sections 187 and 188 (FIG. 27) are provided in the region of the shallow housing section 116. These inner wall sections 187 and 188 also include similar transverse wall sections 183 projecting inwardly therefrom to define respective slots 184 and ledges 185. All of the inner wall sections 181, 182, 187 and 188 are arranged to define a plurality and preferably three support pockets 190 which are configured to receive and support the ground prong slots 163 therein as seen in FIG. 28. As such, the ground contact strip 160 has the respective webs 167 and end tabs 168 extending through the various strip slots 184 and supported on the ledges 185 with the upper edge of the ground contact strip 160 being located substantially flush to the upper edges of the various inner wall sections and transverse wall sections.

When the contact strip 160 is mounted in place, it is located generally over and centrally between the post passages 123 and 124. These post passages 123 and 124 correspond to the common ground and isolated ground conductors of the PDA 12-1 wherein the receptacle 14-1 is configured either for connection to one or other of these ground conductors. The above-described terminal 161 is configured so that it may be positioned within either one of the ground terminal passages 123 or 124 (FIG. 27) and still connect centrally to the ground strip web 167. This terminal 161 (as seen in FIG. 28) is positioned within the passage 124 and due to the offset configuration of the terminal as can be seen in FIG. 38, this terminal 161 still engages the web 167 (as seen in FIG. 31).

In particular, the terminal 161 is first positioned with the contact fingers 173 inserted downwardly into the passage 124 which contact fingers 173 engage an internal ground conductor of the PDA 12-1 when the receptacle 14-1 is plugged therein. With the contact fingers 173 inserted into the appropriate passage 123 or 124, the opposite contact fingers 170 project upwardly into the interior compartment of the housing 14-1. As seen in FIG. 31, the contact fingers 170 project vertically and slidably receive the web 167 of the contact strip 160 through the slot 171 (FIG. 38). The contact fingers 170 therefore resiliently abut against and squeeze against the strip web 167 to define an electrical connection therebetween and complete the electrical circuit between the fingers 173 that engage the PDA and the ground contact strip 160 which is adapted to engage the ground prongs of a conventional outlet. As such, the ground contact strip assembly 146 is in the configuration illustrated in FIG. 28 after assembly.

Referring to FIG. 31, the contact fingers 173 alternatively may be slid into the ground terminal passage 123 while the opposite fingers 170 have the same relative position as that illustrated in FIG. 31 so as to permit engagement of the fingers 170 with the strip web 167. The posts 119 and 120 align with the common and isolated ground conductors so that the ground contact strip assembly 146 may engage either one depending upon the installed position of the ground terminal 161.

Turning to the circuit contact strip assemblies 145, the strip assemblies 145 are installed in substantially the same manner as that described above relative to the embodiment of FIGS. 1–20.

More particularly, the support projections 180 are formed with additional outer wall sections 192 which define additional pockets 193 that align with the outlet openings 111 and 112 and are adapted to receive the plate slots 149 of the contact strip 148. The outer wall sections 192 and the inner wall sections 181 and 182 further include transverse wall segments 194 which are arranged in opposing pairs to define a respective slot 195 therebetween and a support ledge 196. As such, four blade-receiving pockets 193 are provided.

Still further, additional outer support sections 198 are provided, which effectively perform similar to the outer wall sections 192, in opposing relation with transverse wall segments 194. These support sections 198 are disposed adjacent to the transverse wall segments 194 located on the secondary inner wall sections 187 and 188 to thereby define a respective slot 195 and support ledge 196. These slots 195 and 196 are adapted to support the strip end tabs 168 thereon as seen in FIG. 26 while the remaining webs 167 and end tab 168 of each contact strip 160 extend through the slots 195 and are supported on these support ledges 196 adjacent to the outer wall sections 192. In this manner, the contact strips 160 are supported closely adjacent to the front housing wall 109 with the blade slots 149 being located closely adjacent to the outlet openings 111 and 112. Once mounted in position, the flexible conductors 153 project downwardly and outwardly so that the associated terminals 157 may be inserted into the respective passages 134 and 135 of the posts 132 and 133. As can be seen, the relative depth between the contact strip 148 and the terminal 157 is identified in FIG. 30 by reference arrow 200 which depth is substantially greater than the depth 92 depicted in FIG. 11 for the receptacle 14. This common construction for the contact strip assemblies 145 and the prior contact strip assemblies 42 thereby allows the difference in dimensions 92 and 200 to be readily accommodated.

Hence, the internal constructions of the receptacles 14 and 14-1 are substantially similar yet still allow for a cost efficient design for these two receptacle constructions.

The above-described receptacle constructions are further adapted to construct the preferred receptacle constructions disclosed herein relative to FIGS. 41–60. These receptacle constructions use relatively common components like the receptacles 14 and 14-1 and hence, the following discussion is primarily directed to the differences between such constructions.

Referring to FIGS. 41–49, an additional receptacle 14-2 is illustrated therein which incorporates the design principles discussed above and includes further modification thereto. It will be understood that the receptacles for all of remaining FIGS. 41–68 are designed for and usable with conventional power distribution assemblies such as those PDA's referenced above and hence, further illustration and discussion of such PDAs is not provided hereinafter.

Figure 42:
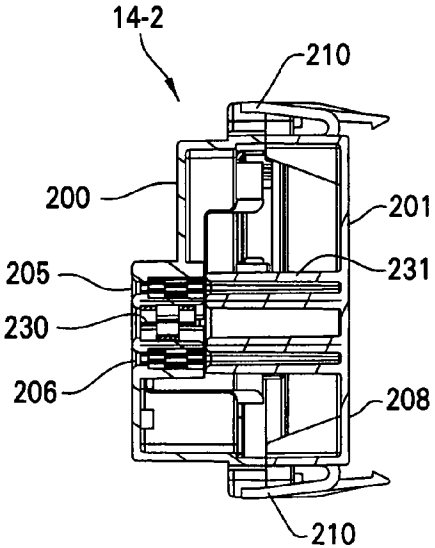
FIG. 42 is a cross-sectional end view of the receptacle as taken along line 42—42 of FIG. 41.
Figure 41:
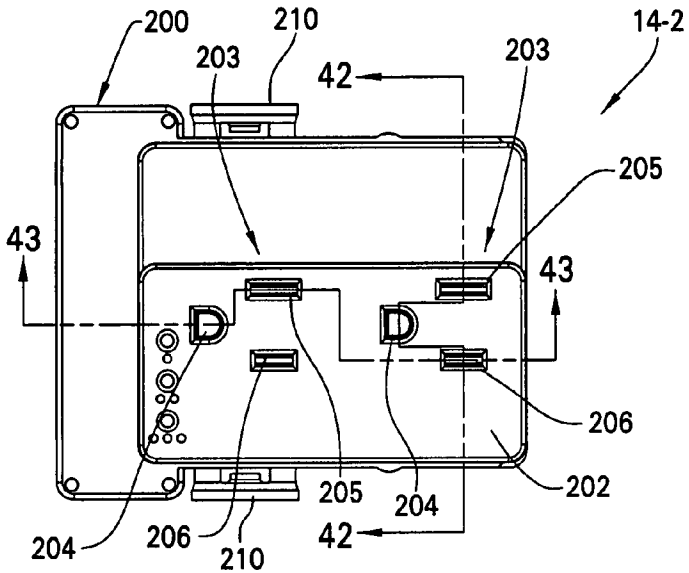
FIG. 41 is a front view of a third embodiment of a receptacle.
Figure 43:
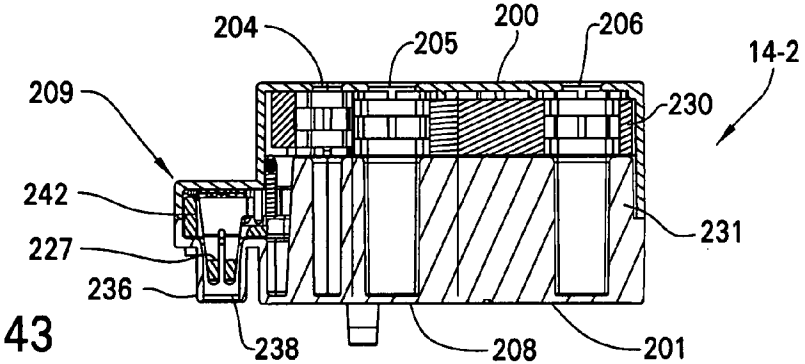
FIG. 43 is a bottom cross-sectional view as taken along line 43—43 of FIG. 41.

Turning to FIGS. 41–43, the receptacle 14-2 comprises a front housing 200 which mates to a back housing 201. The front housing includes a front wall 202 having a plurality of outlets 203 defined by prong openings 204, 205 and 206. The back housing 201 also includes a back wall 208.

Additionally, front and back housings 200 and 201 define a shallow housing section 209 projecting sidewardly therefrom.

Figure 44:
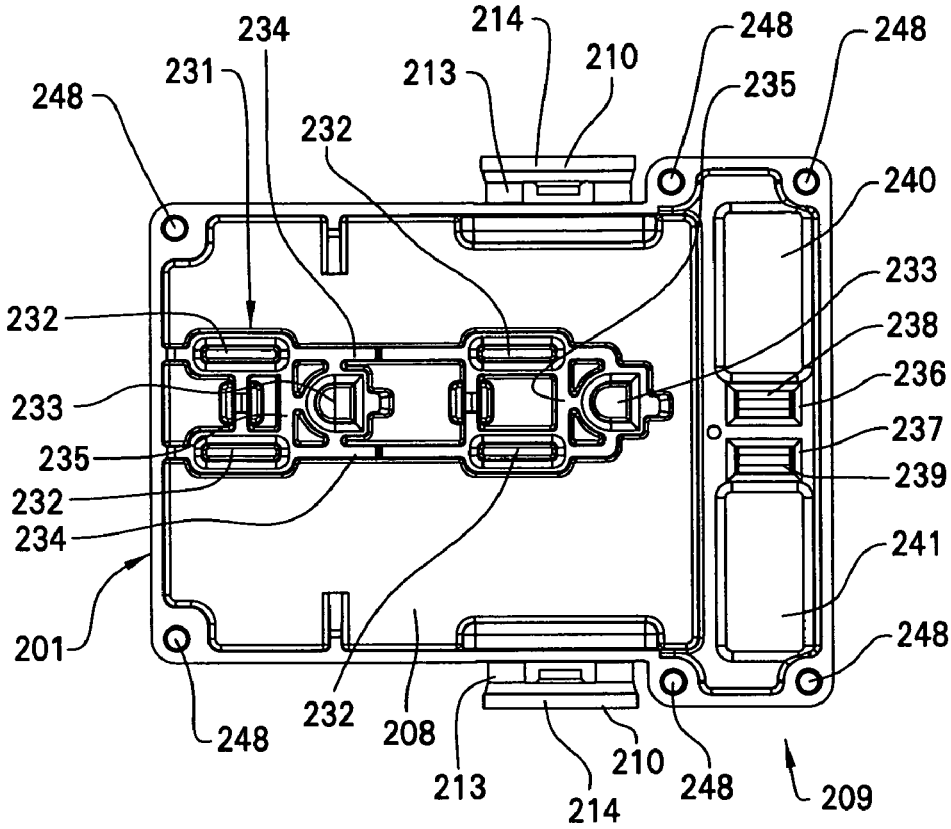
FIG. 44 is a plan view of the back housing thereof.
Figure 45:
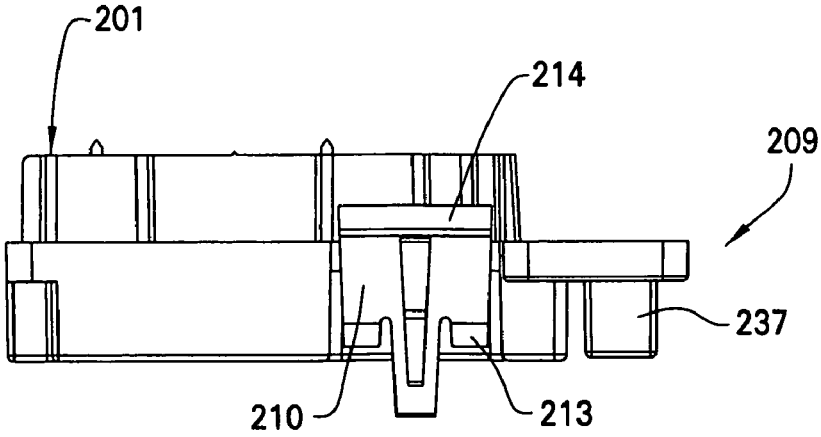
FIG. 45 is a side view of the back housing.
Figure 46:
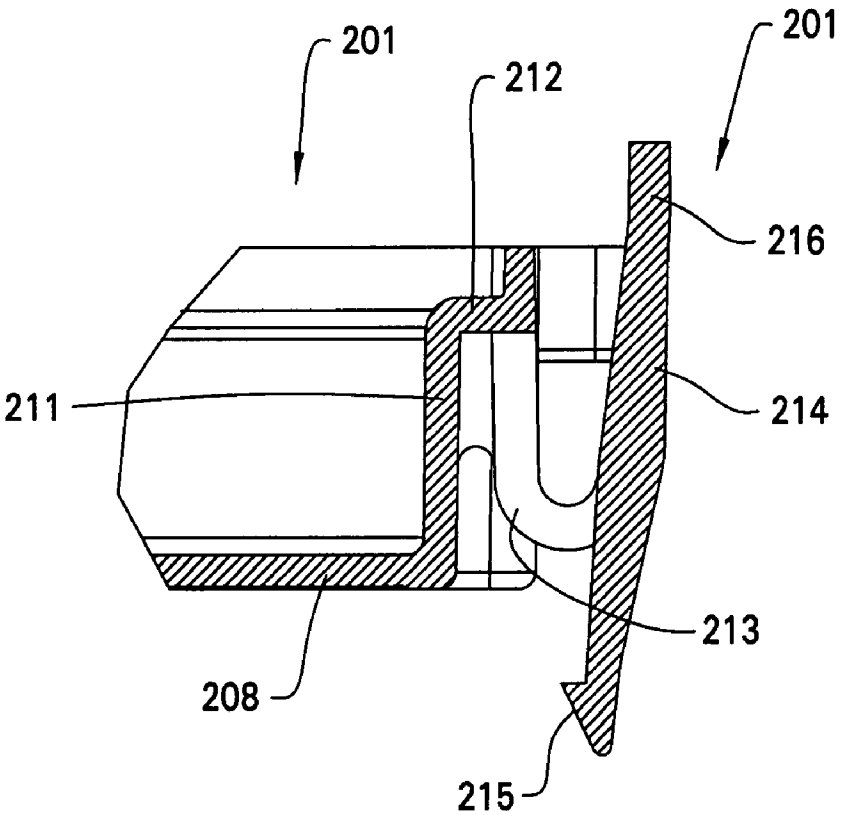
FIG. 46 is a partial enlarged view of a locking finger for the receptacle.

Referring to FIGS. 44–46, the receptacle also includes a pair of cantilevered lock arms 210 which hook onto a PDA when the receptacle 14-2 is engaged in place. Referring to FIG. 46, the back housing 201 is formed with a sidewall 211 which has a stepped section 212 to define a recessed section on the opposite sides of the receptacle 14-2.

The entire back housing 201 is formed of a molded plastic in such a manner so as to include a J-shaped support arm 213 which extends downwardly in generally parallel relation with the housing sidewall 211. This support arm 213 curves outwardly and is molded in a one-piece configuration with a locking arm 214. The resiliency of the support arm 213 permits resilient pivoting of the lock arm 214. The lock arm has a hooked end 215 which is adapted to hook onto a PDA and further has a finger pad 216 which may be pressed inwardly by the fingers of a user to pivot the hooked end 215 outwardly out of engagement with a PDA.

Figure 47:
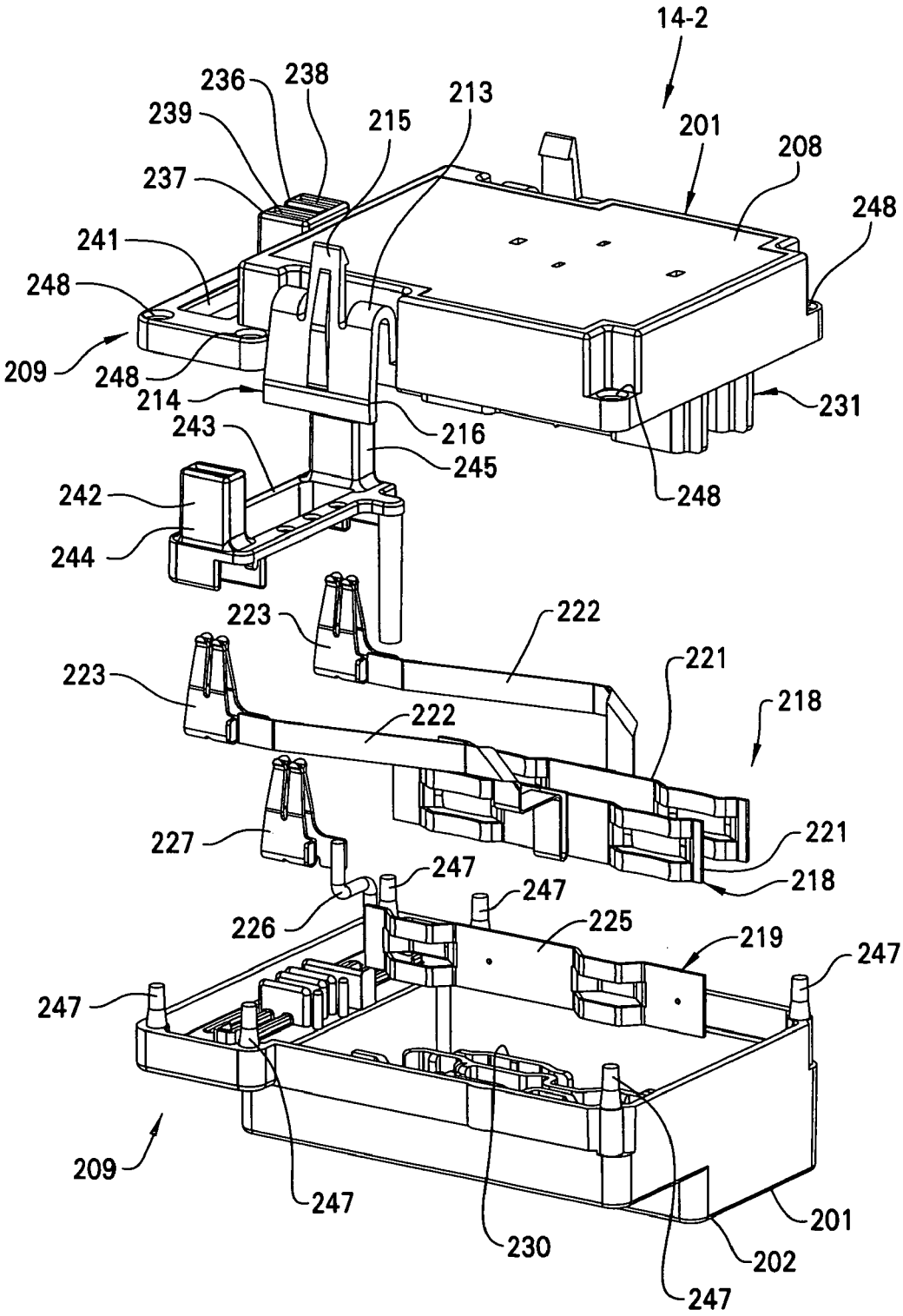
FIG. 47 is an exploded isometric view of the receptacle.

Referring to FIG. 47, the receptacle 14-2 further includes a pair of contact strip assemblies 218 and a further ground contact strip assembly 219 which is adapted to be positioned within the receptacle 14-2 between the assemblies 218 in the same physical location as that described above relative to the receptacles 14 and 14-1. The receptacle 14-2 is constructed most similar to the receptacle 14 described above.

The contact strip assembly 218 (FIG. 47) has a duplex configuration comprising a contact strip 221, a flexible intermediate conductor 222 and a terminal 223. The flexible intermediate conductor 222 in this embodiment preferably is formed of a length of flat copper conductor which has been bent so as to have flexibility in both a front to back direction and a side to side direction similar to the flexibility provided by the wire conductors described above.

The ground contact strip assembly 219 (FIGS. 47–49) further is formed from a contact strip 225 having a more rigid brass wire connector 226 attached at one end thereof which has a terminal 227 supported thereon. The contact strip assemblies 218 are provided for engagement with the hot and neutral conductors of the PDA while the ground contact strip assembly 219 is adapted for connection to either a common ground or isolated ground of the PDA.

Referring to FIGS. 42 and 43, the receptacle 14-2 further includes a support projection arrangement 229 which is configured similar to and functionally locates the contact strips 221 and 225 directly adjacent the interior face of the front housing wall 202 in substantially the same arrangement as the support projections described above such as support projections 55.

The support projection arrangement 229 differs from the support projection arrangement disclosed in FIGS. 1–40 in that arrangement 229 comprises a front support section 230 and a back support section 231. The front support section 230 is adapted to receive the contact strips 221 and 225 therein in alignment with the outlet openings 204, 205 and 206. The back support section 231 therefore abuts against the contact strips 221 and 225 in the opposing interior face of the front section 230 so as to maintain the contact strips 221 and 225 directly adjacent the front housing face. In effect, the support projection arrangements of FIGS. 1–40 are the same except that portions thereof are provided on both the front and back housings in the embodiment of FIGS. 41–49 as well as the remaining embodiments of FIGS. 50–60.

Referring to FIG. 44, the back support section 231 is formed by a pattern of molded ribs which project upwardly from the back housing wall 208 to an elevation which projects into the front housing section 200 as generally illustrated in FIGS. 42 and 43. This back support section 231 (FIG. 44) is molded during the molding of the back housing 201 and generally is provided with vertical slots or cavities 232 which align with and are adapted to receive the free ends of the hot and neutral blades of a conventional electrical plug when plugged into the outlets 203. Additionally, back support section 231 includes a pair of prong cavities 233 which align with and are adapted to receive the free ends of conventional ground prongs of the electrical plug. Additionally, the back section 231 includes additional elongate ribs 234 which are adapted to abut against the contact strips 221 to maintain these in place. Also, transverse ribs 235 are provided to maintain the position of the ground contact strip 219.

Lastly as to the back housing 201, the shallow end section 209 thereof is provided with two fixed ground posts 236 and 237 which each have a passage 238 and 239 extending therethrough for receiving the ground terminal 227 therein as seen in FIG. 43.

Furthermore, the shallow section 209 includes a pair of slide windows 240 and 241 which are adapted to slidably engage the slide block 242 (FIG. 47). The slide block 242 as seen in FIG. 47 includes a main body 243 having insulative hollow posts 244 and 245 which are each adapted to receive one of the terminals 223 therein, wherein the slide block 242 is movable sidewardly along the windows 240 and 241 when selecting the specific circuit of a PDA to which the receptacle 14-2 will be electrically connected.

As to the front housing 200, the front housing 200 also includes fastener pins 247 at the corners thereof which align with and project through fastener bores 248 in the back housing 220 to permit heat staking of the front and rear housings 200 and 201 together.

Referring to FIGS. 42, 43, 48 and 49, the front housing 200 includes the front section 230 of the support projection arrangement 229 therein. This front section 230 includes molded, upstanding support walls in an arrangement similar to that previously discussed above. The support walls define thin pockets 250 and slots therebetween so that the contact strips 221 may be slid downwardly therein. The flexible conductors 222 then extend inwardly into the interior of the housing and have the terminals 223 positioned for support within the slide block 242 and specifically within the posts 244 and 245 of the slide block 242.

Figure 49:
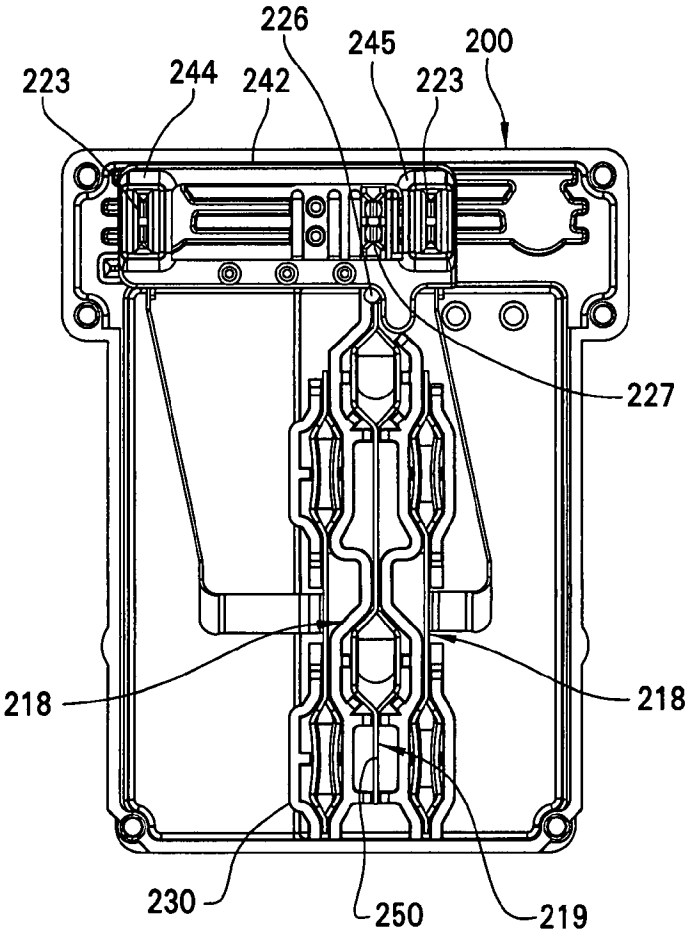
FIG. 49 is a plan view of a front housing with a contact strip assembly mounted therein with a ground strip configured for an isolated ground connection.
Figure 48:
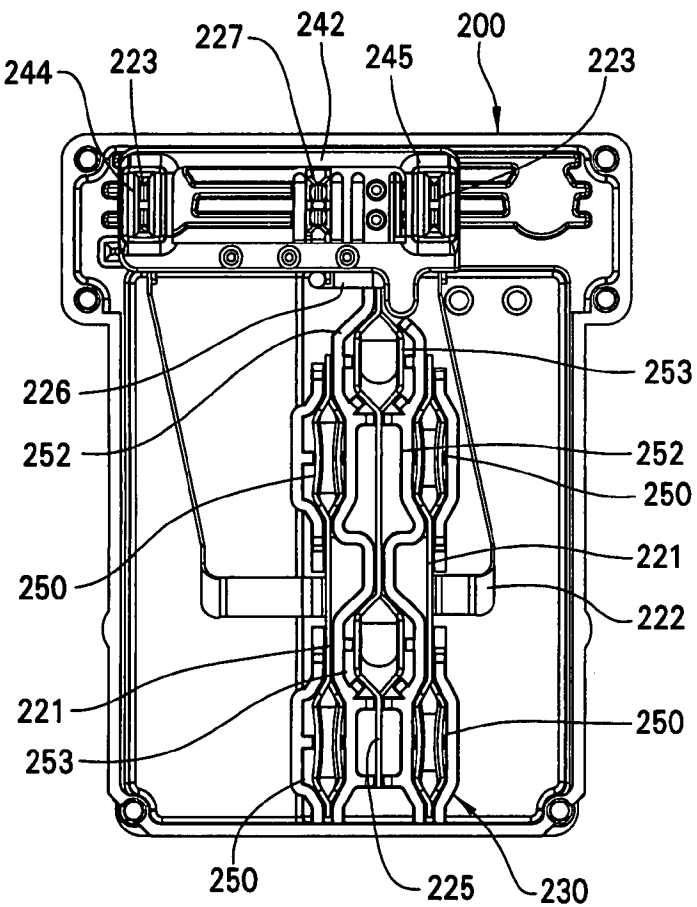
FIG. 48 is a plan view of a front housing with a contact strip assembly mounted therein with a ground strip configured for a common ground connection.
Figure 50:
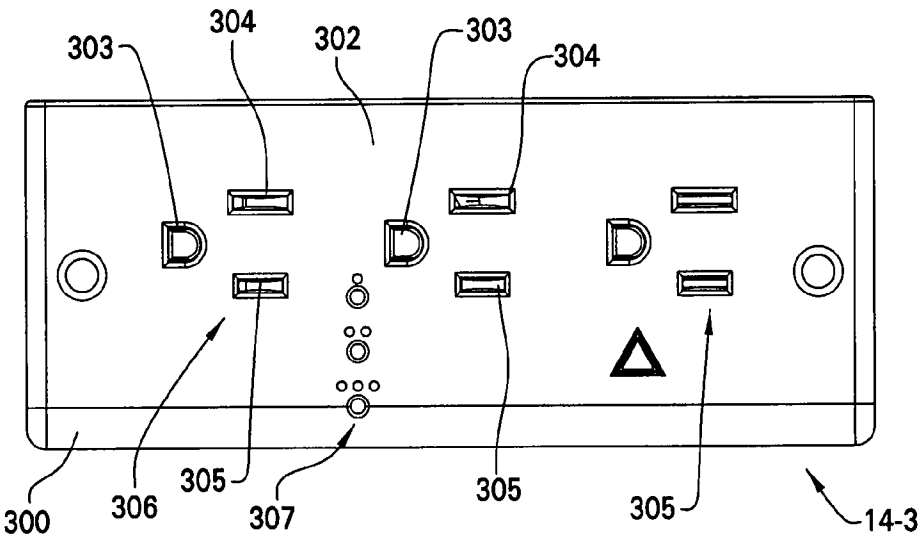
FIG. 50 is a plan view of a fourth embodiment of a receptacle.
Figure 52:
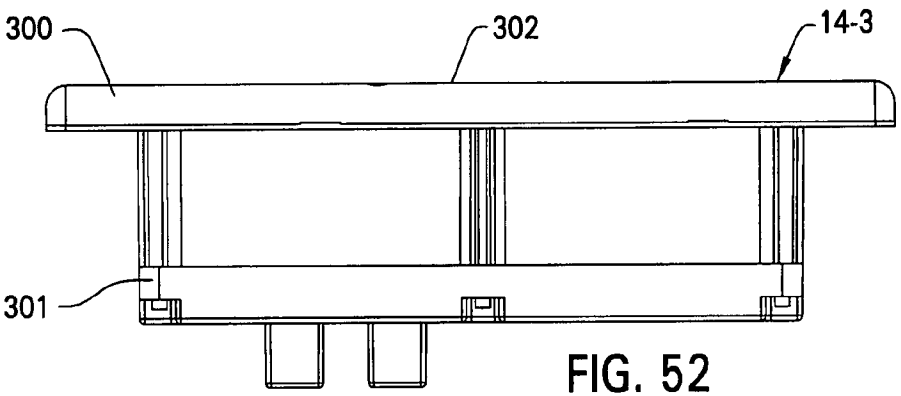
FIG. 52 is a side view of the receptacle.
Figure 51:
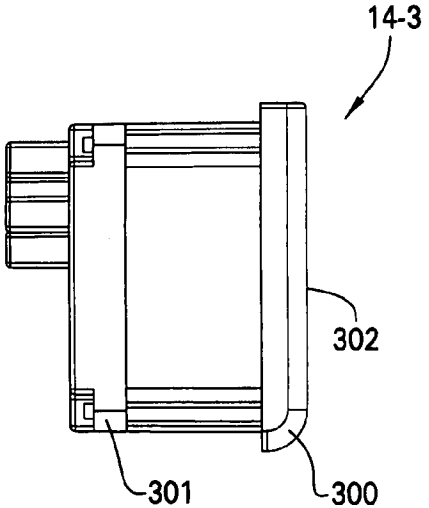
FIG. 51 is an end view of the receptacle.

As seen in FIG. 48, the front support section 230 also includes inner wall sections 252 which define additional pockets 253 for supporting the ground contact strip 225 therein. In the arrangement of FIG. 48, the intermediate conductor 226 extends to one side of the contact strip 225 to position the respective terminal 227 for engagement with the post 237 to engage one of the common ground and isolated ground conductors of the PDA. As seen in FIG. 49, the conductor 226 extends to the opposite side of the contact strip 250 to position the terminal 227 for receipt within the other insulative post 236 of the back housing 201. The contact strip assemblies 218, however, remain unchanged.

Therefore, with the foregoing arrangement, the same features are incorporated herein in the receptacle 14-2 except that the contact strips are supported directly on the front housing 200.

Referring next to FIGS. 50–57, a further embodiment of the receptacle 14-3 is illustrated in a triplex configuration. This receptacle 14-3 is illustrated in particular in FIGS. 50–52 includes a front housing 300 and a back housing 301. The front housing 300 has a front wall 302 which includes three sets of ground, hot and neutral openings 303, 304 and 305 so as to thereby define three outlets that are accessible through the front housing wall 302. The front housing wall 302 also includes a circuit indicator 307 formed by three spaced apart bores extending therethrough.

Figure 53:
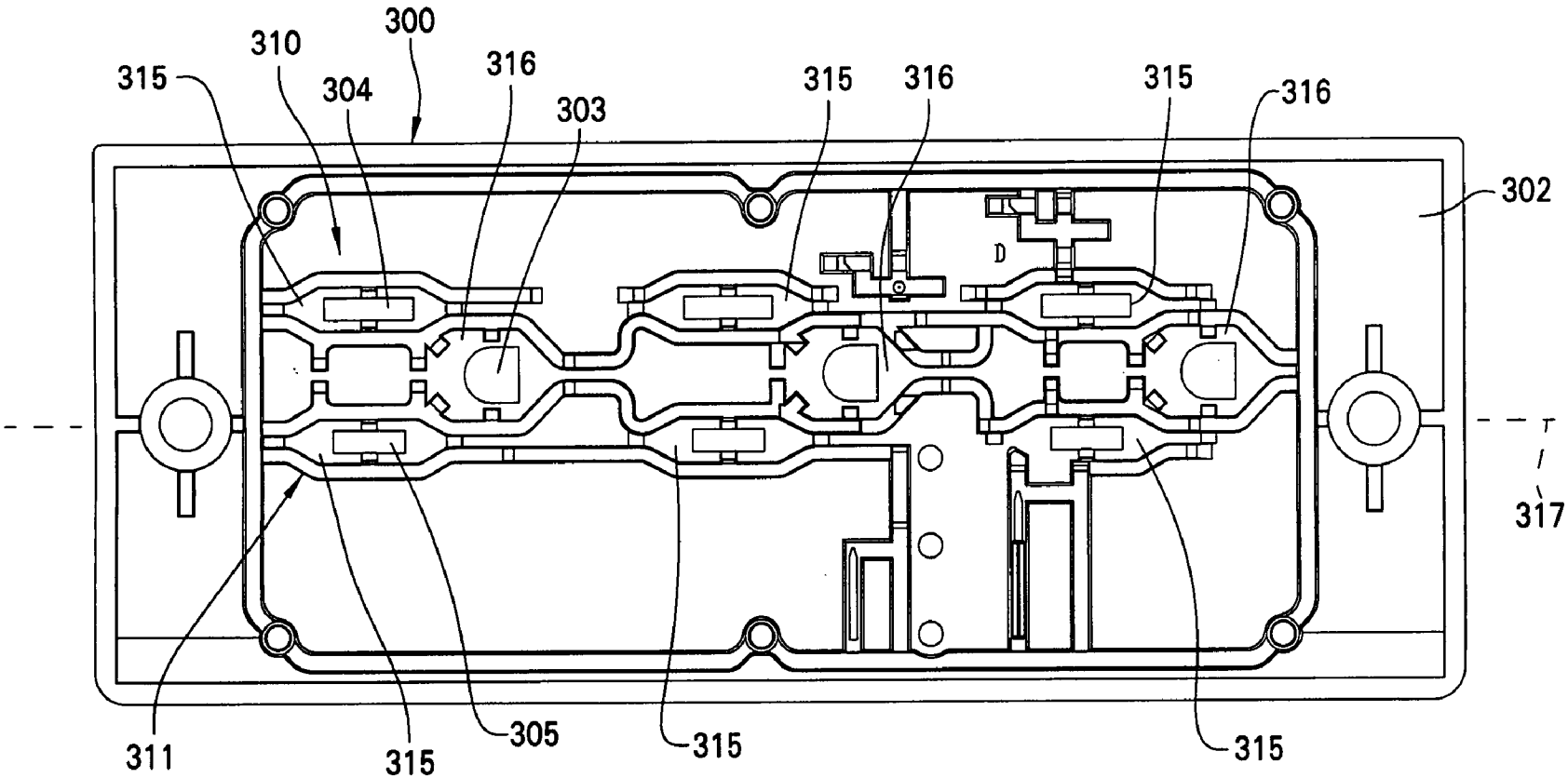
FIG. 53 is a plan view of the interior of the front housing for the receptacle.

Referring to FIG. 53, the front housing 300 includes a support projection arrangement 310 which comprises a front support section 311 (FIG. 53) and a back support section 312 which front and back sections 311 and 312 are formed substantially similar to the front and back support sections 230 and 231 described above.

Referring again to FIG. 53, the front support section 310 includes patterns of molded ribs or support walls which project from the inside face of the front housing wall 302 to define circuit cavities 315 and ground cavities 316 which align with the outlet openings 304–306 to permit insertion of hot and neutral prong blades therethrough as well as ground prongs. As seen in FIG. 53, these various cavities 315 and 316 are offset upwardly relative to the longitudinal centerline 317 of the front housing 300.

Referring to the back housing 301, the back support section 312 thereof projects forwardly and abuts against the inside edges of the front support section 311 so as to retain contact strips within the cavities or pockets 315 and 316 in substantially the same manner as that described above.

The back housing 301 also includes a pair of terminal posts 319 and 320 which project rearwardly and are vertically staggered relative to each other. Each post 319 and 320 defines a terminal passage 321 or 322 therethrough as will be described in further detail herein.

Figure 54:
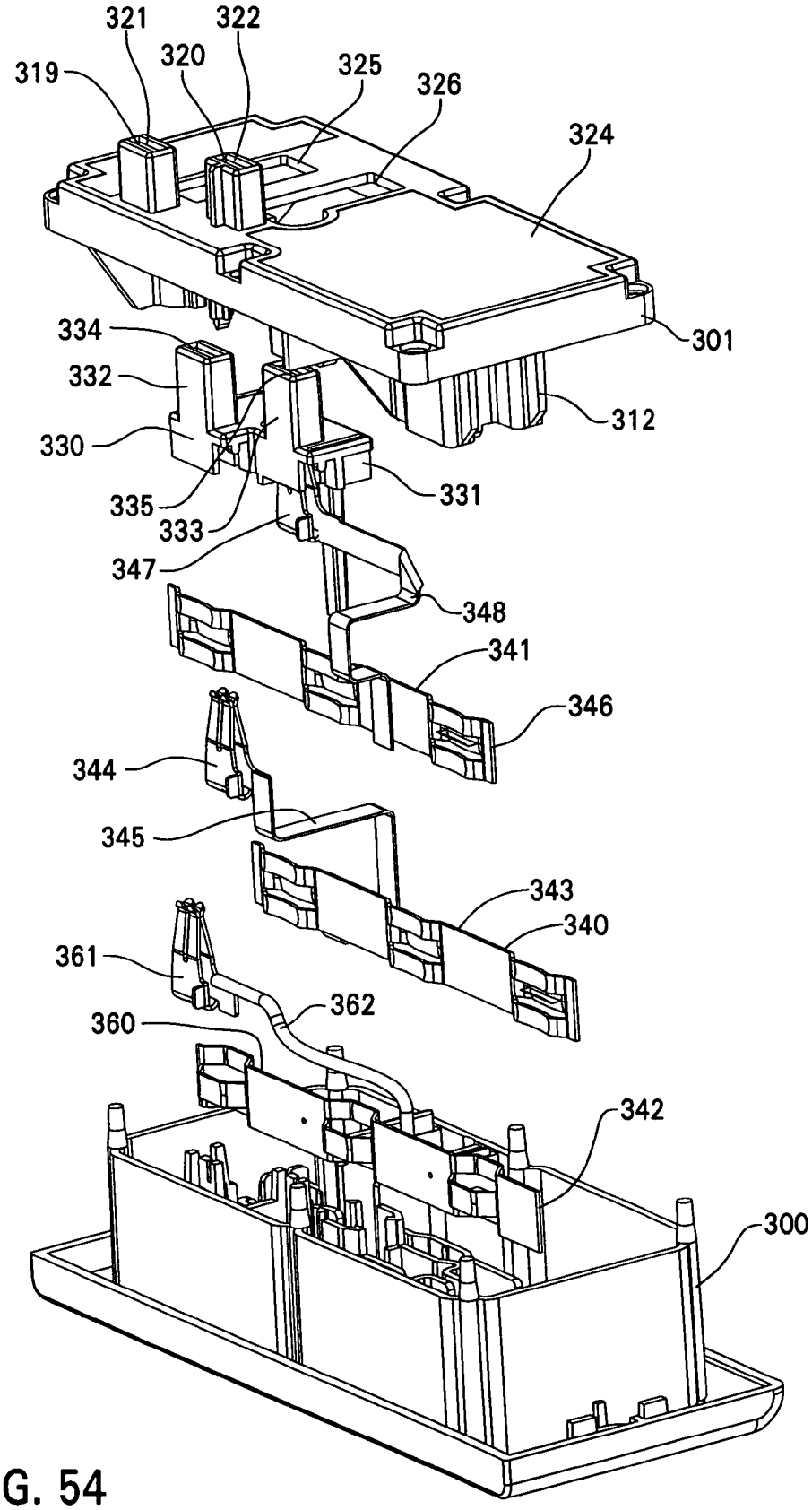
FIG. 54 is an exploded perspective view of the receptacle.
Figure 56:
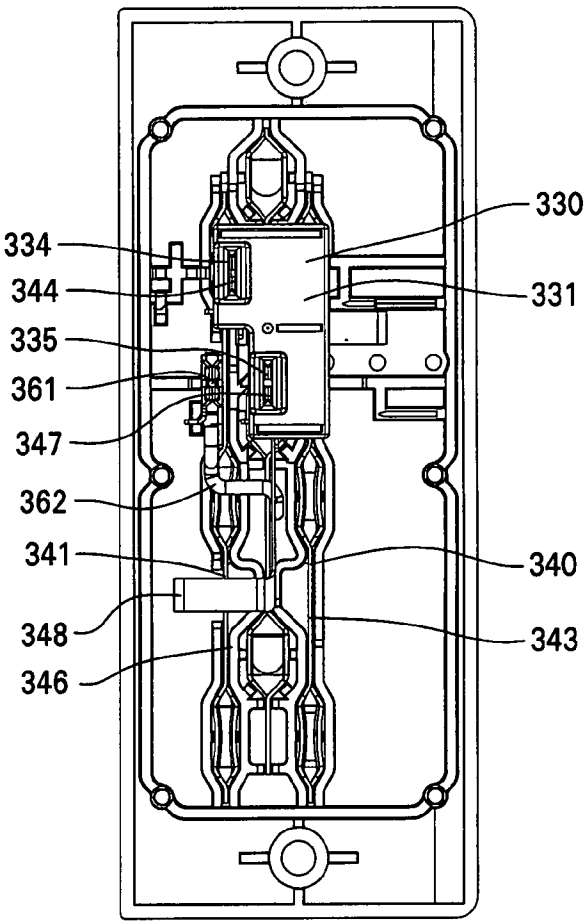
FIG. 56 is a plan view of a front housing with a contact strip assembly mounted therein with a ground strip configured for an isolated ground connection.
Figure 55:
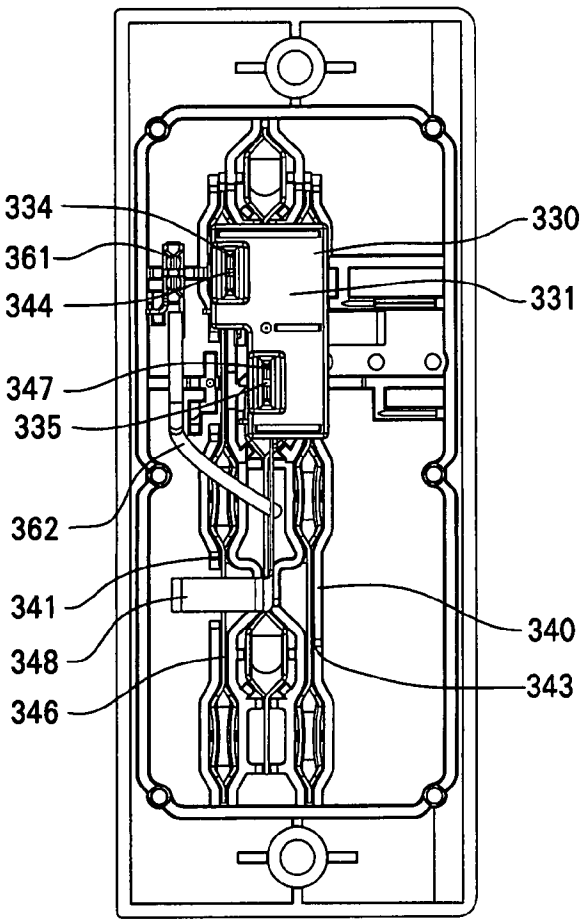
FIG. 55 is a plan view of a front housing with a contact strip assembly mounted therein with a ground strip configured for a standard ground connection.
Figure 57:
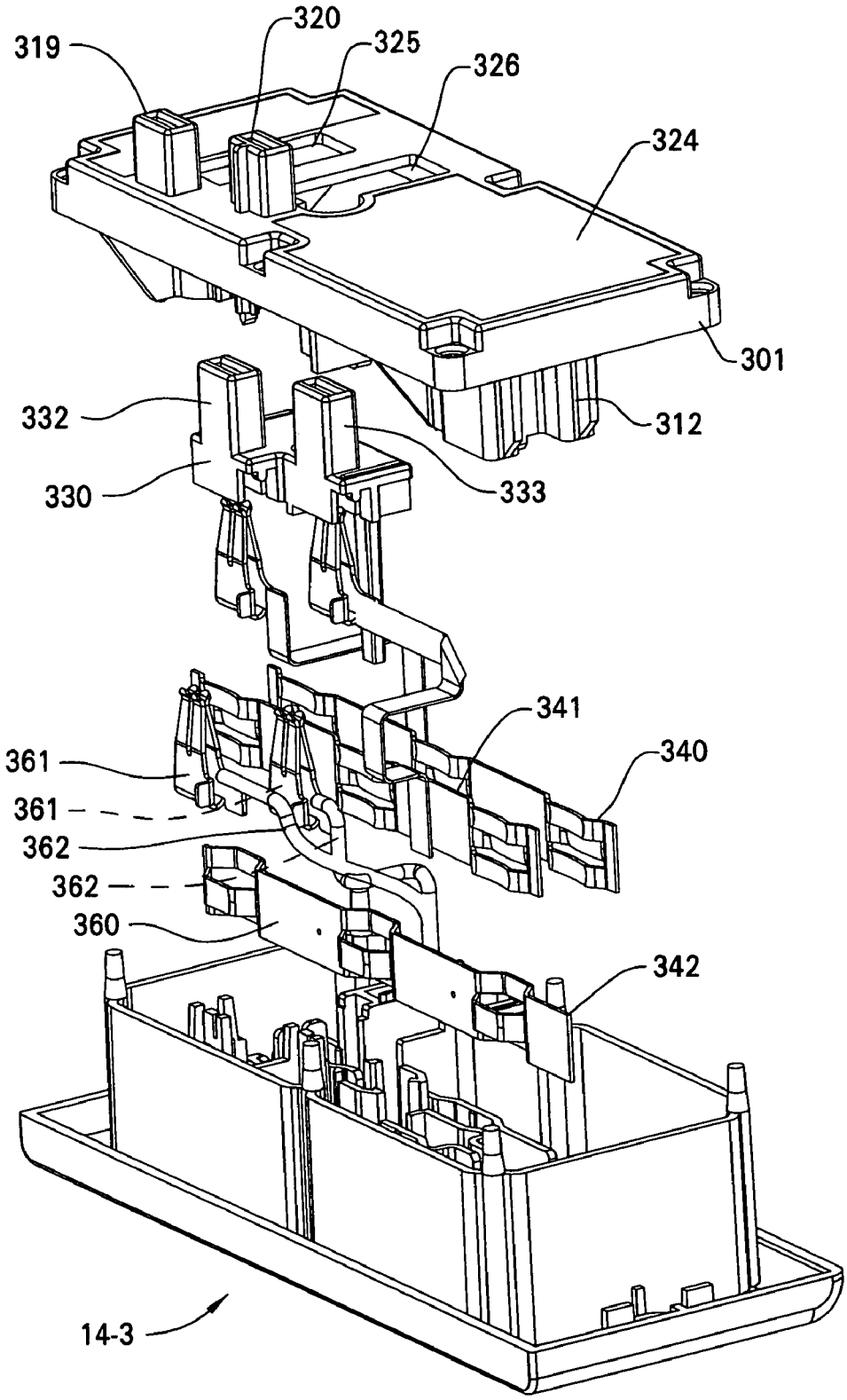
FIG. 57 is a further exploded isometric view of the receptacle.

Still further, the rear wall 324 of the back housing 301 includes a pair of slider windows 325 and 326 which are arranged side by side to each other and vertically offset relative to each other. Notably, each window 325 and 326 is generally aligned with a respective one of the posts 320 and 321 as seen in FIG. 54 wherein the windows 325 and 326 are adapted to slidably support a slider 330 (FIGS. 54–56). The slide block 330 includes a slide body 331 and a pair of terminal posts 332 and 333 which each define a respective passage 334 and 335 therethrough. Generally, the terminal posts 332 and 333 on the slide block 330 are adapted to connect to associated pairs of hot and neutral conductors of a PDA wherein each pair is associated with one circuit defined in a PDA. Sliding of the slide block 330 along the windows 325 and 326 allows these terminal posts 332 and 333 to be aligned with a selected one of the multiple circuits defined within the PDA. The ground posts 319 or 320 are configured so that one or the other includes a ground terminal therein for connection to either an isolated ground or common ground of the PDA.

Referring to FIGS. 54–57, the receptacle 14-3 is provided with a pair of hot and neutral circuit contact strip assemblies 340 and 341 and a ground contact strip assembly 342. Generally, these contact strip assemblies 340–342 are formed substantially similar to those components described above and are structurally and functionally very similar thereto.

More specifically for this arrangement, the contact strip assembly 340 comprises a contact strip 343, a terminal 344, and a flexible intermediate conductor 345 extending therebetween which is flexible so as to permit movement of the slide block 330. The flexible conductor 345 is formed of bent copper conductor.

As for the contact strip assembly 341, this contact strip assembly 341 also includes a contact strip 346, a terminal 347 and a flexible intermediate conductor 348. The terminals 344 and 347 respectively fit into the terminal posts 333 and 332 and thereby are movable therewith. The associated contact strips 343 and 346 are adapted to fit into the front support section 310 and specifically fit into the pockets 315 as seen in FIGS. 55 and 56. As to the ground contact strip assembly 342, this contact strip assembly 342 includes a contact strip 360, a ground terminal 361 and an intermediate conductor 362 which may either be in a first position illustrated in FIG. 7 in solid outline or a second position identified by the reference line in phantom outline in FIG. 57. More particularly, the terminal 361 and conductor 362 are illustrated in the first position in FIG. 55 with the terminal 361 disposed in the terminal post 319. This same terminal 361 may alternatively be positioned in the post 333 by rerouting the flexible conductor 362 as illustrated in FIG. 56. These alternate positions for the ground terminal 361 allow for connection to either the common ground or isolated ground of the PDA. The receptacle 14-3 or FIGS. 50–57 thereby illustrates an alternate configuration for the receptacle construction of the invention.

Figure 59:
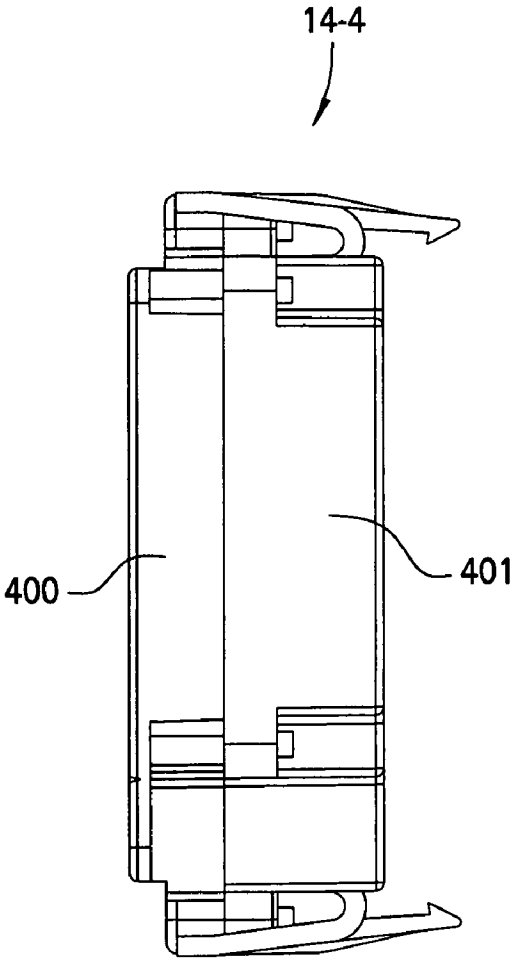
FIG. 59 is an end view thereof.
Figure 58:
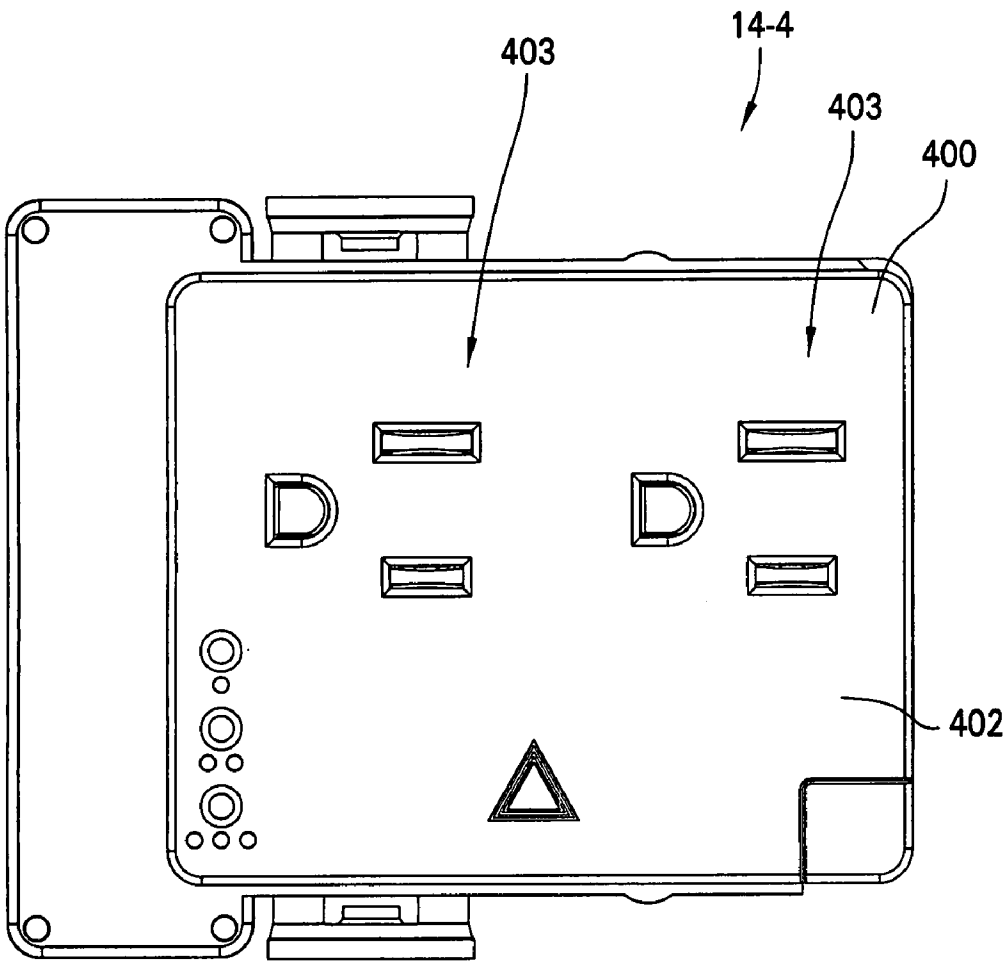
FIG. 58 is a plan view of a fifth embodiment of a receptacle.
Figure 60:
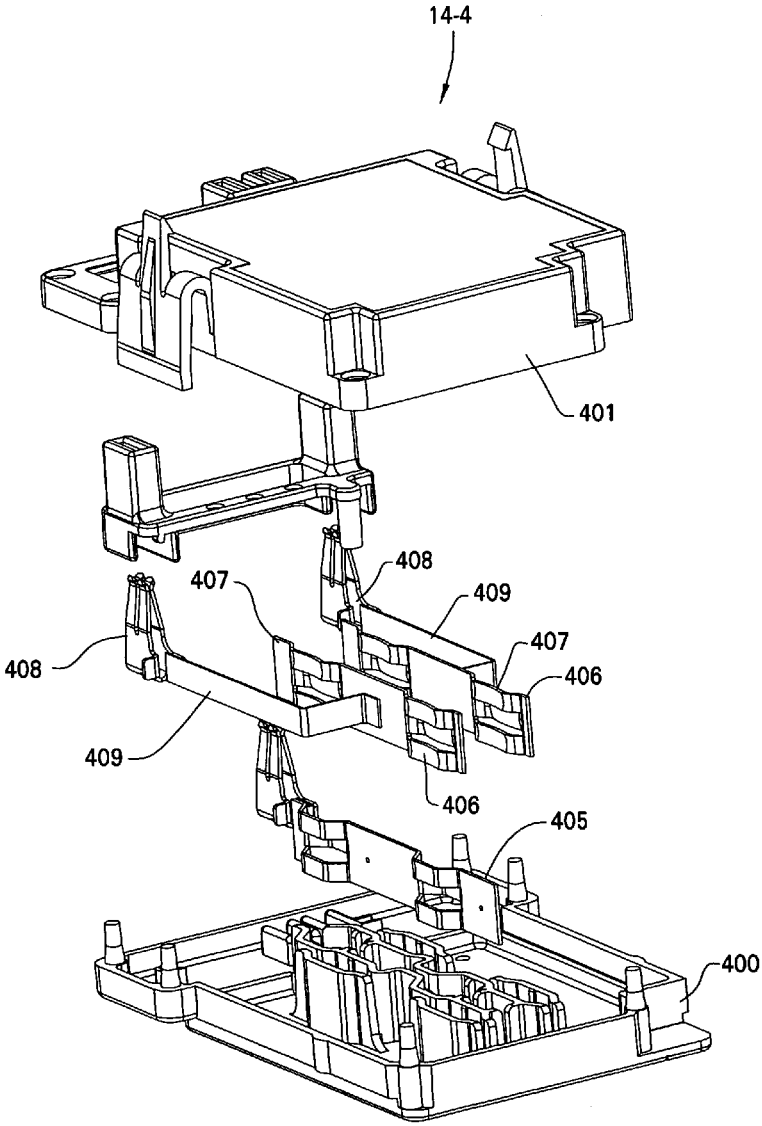
FIG. 60 is an exploded isometric view of the receptacle.

Referring to FIGS. 58–60, a further embodiment of a receptacle 14-4 is illustrated therein. The receptacle 14-4 is substantially similar to those described above in that it includes front and back housings 400 and 401 wherein the front wall 402 of the front housing 400 includes openings that define a pair of outlets 403 in a duplex configuration.

Referring to FIG. 60, the detailed discussion of the internal components is not required in that these components are substantially similar to those described above. However, the interior of the housing defined by the front and back housings 400 and 401 similarly includes a ground contact strip assembly 405 and a pair of circuit contact strip assemblies 406. The circuit contact strip assemblies comprise a contact strip 407, a respective terminal 408 and a flexible conductor 409 therebetween.

Notably, the receptacle 14-4 has a generally thin dimension in the front to back direction so that the flexible conductors 409 need only flex in a plane that lies generally parallel to the front wall 402 and it is not necessary to provide flexure of the flexible conductors 409 in the front to back direction.

Referring to FIGS. 61–66, a further receptacle 14-5 is illustrated which illustrates a further variation of the housing construction. The receptacle 14-5 includes a modified front housing 500 which mates to a back housing 501. The front housing includes a front wall 502 having a plurality of outlets 503. The back housing 501 also includes a back wall 508. Additionally, front and back housings 500 and 501 define a shallow housing section 509 projecting sidewardly therefrom like that illustrated in FIGS. 41–42 although unlike this above-described housing, the receptacle 14-5 includes the spring clip 30 (FIGS. 3B–3D) mounted thereto. The receptacle 14-5 further includes a pair of contact strip assemblies and a further ground contact strip assembly like those described above which contact strip assemblies are adapted to be positioned within the receptacle 14-5.

Referring to FIGS. 61–66, the receptacle 14-5 further includes a support projection arrangement 510 which is configured similar to and functionally locates the contact strips directly adjacent the interior face of the front housing wall 502 in substantially the same arrangement as the support projections described above such as support projections 55.

Figure 63:
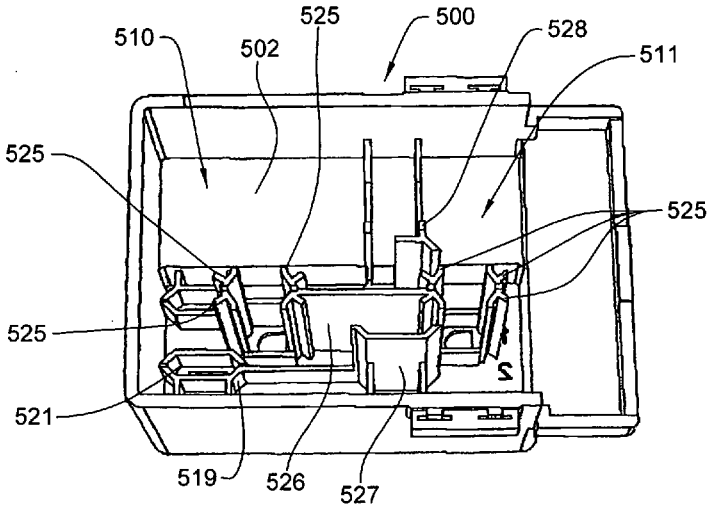
FIG. 63 is an isometric view of the front housing.
Figure 64:
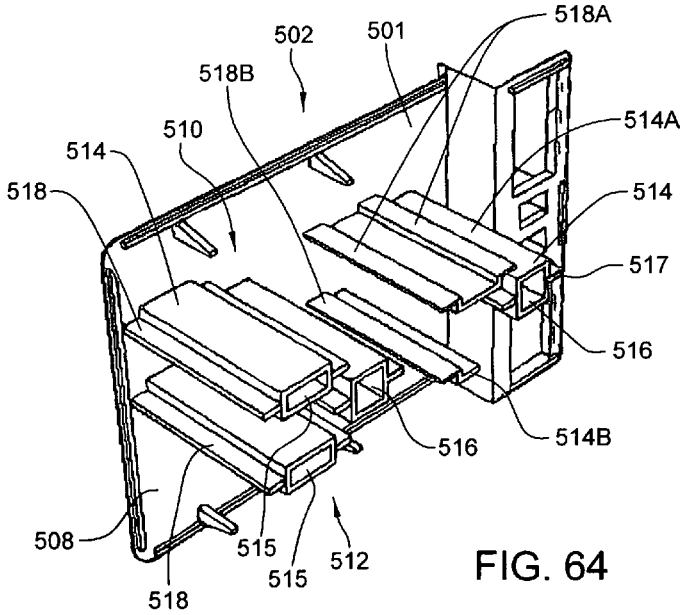
FIG. 64 is an isometric view of a back housing.
Figure 66:
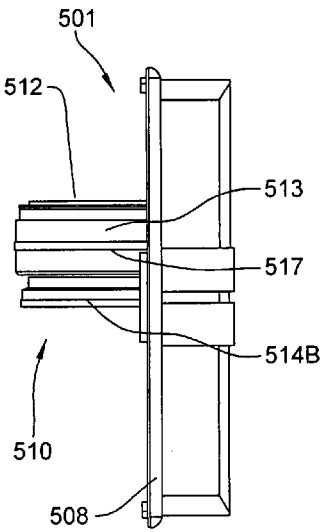
FIG. 66 is an end view of the back housing.
Figure 65:
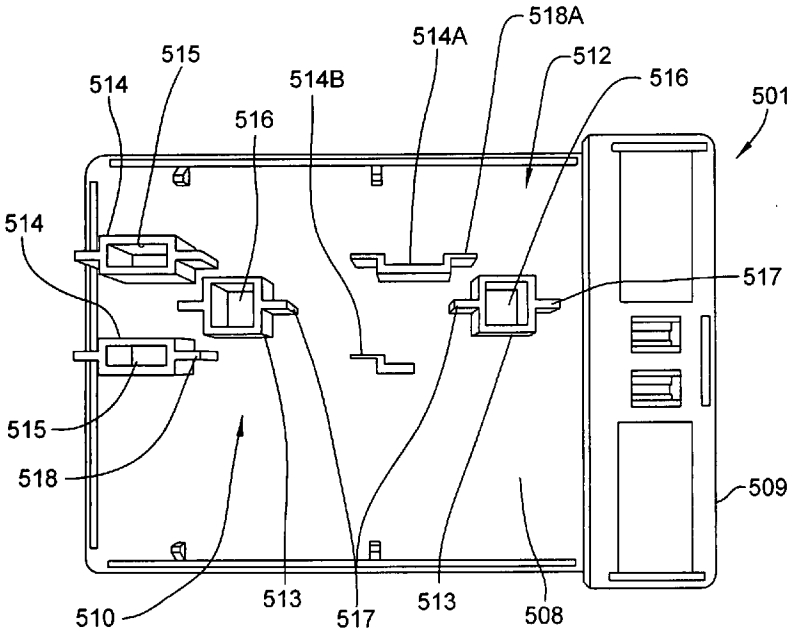
FIG. 65 is a facing view of the back housing.

The support projection arrangement 510 comprises a front support section 511 (FIGS. 61–63) and a back support section 512 (FIGS. 64–66). The front support section 511 is adapted to receive the contact strips therein in alignment with the openings of the outlets 503. The back support section 512 therefore abuts against the contact strips so as to maintain the contact strips directly adjacent the front housing wall 502. Generally, the front and rear support sections 511 and 512 each include interfitting patterns of tall and short walls which locate the contact strips and maintain same against the front housing wall 503.

Referring to FIGS. 64–66, the back support section 512 is formed by a pattern of upright columns 513 and 514 which project upwardly from the back housing wall 508 to an elevation which projects into the front housing section 500. It is noted that additional column portions 514A and 514B are provided which essentially are formed as portions of a complete column 514

This back support section 512 generally is provided with vertical slots or cavities 515 in the columns 514 and column portions 514A, 514B which align with and are adapted to receive the free ends of the hot and neutral blades of a conventional electrical plug when plugged into the outlets 503.

Additionally, back support section 512 includes a pair of prong cavities 516 in the columns 513 which align with and are adapted to receive the free ends of conventional ground prongs of the electrical plug. Additionally, the back section 512 includes additional elongate ribs 517, 518, 518A and 518B which are adapted to abut against the contact strips to maintain these in place.

Figure 61:
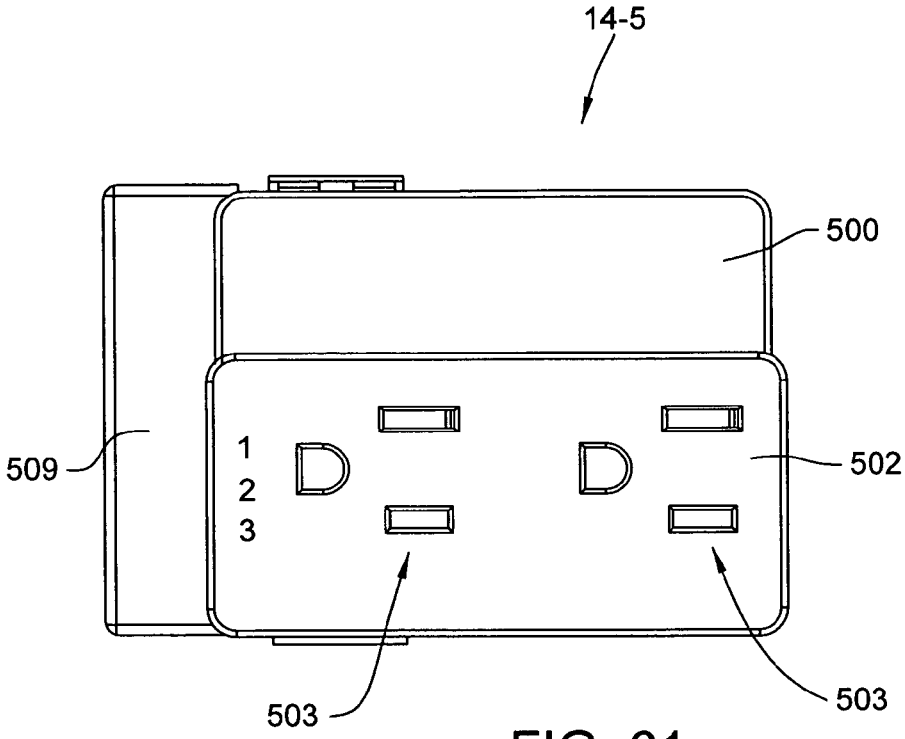
FIG. 61 is a plan view of a sixth embodiment of a receptacle.
Figure 62:
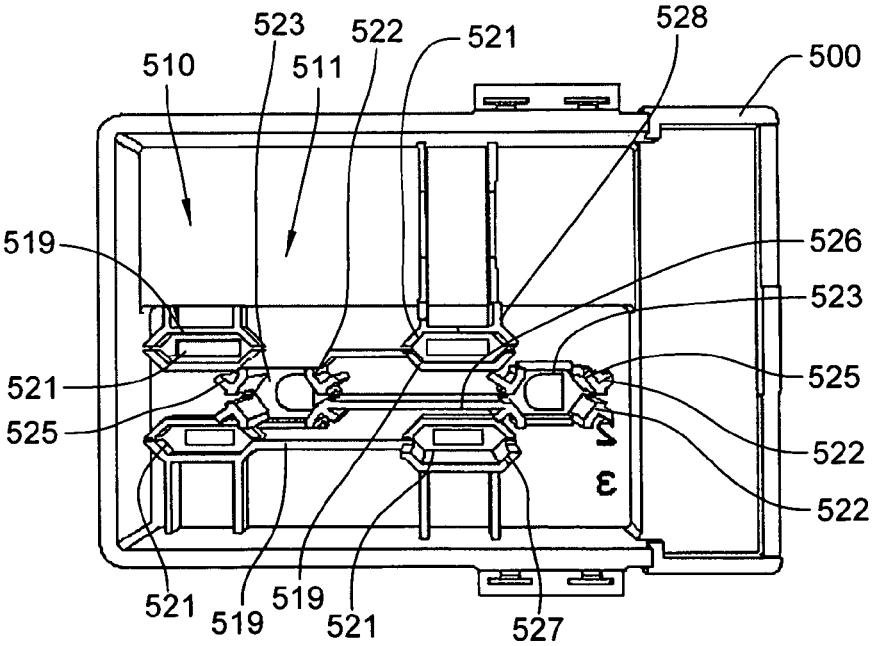
FIG. 62 is an inside view of the front receptacle housing.

Referring to FIGS. 61–63, the front housing 500 includes the front section 511 of the support projection arrangement 510 therein. This front section 511 includes molded, upstanding support 519 walls in an arrangement similar to that previously discussed above. The support walls define thin pockets 520 and slots therebetween so that the hot or neutral contact strips may be slid downwardly therein.

The front support section 511 also includes inner wall sections 522 which define additional pockets 523 for supporting the ground contact strip therein. Extended wall portions 525 through 528 are substantially higher and aligned with the opposing column portions of the rear housing 501 such that the support projection arrangement defines tubular upright columns that support the contact strips adjacent the front housing wall 502.

Structurally and functionally, the support projection arrangement is similar to that described above relative to FIGS. 41–49.

Figure 68:
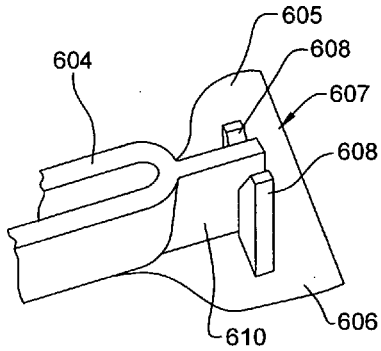
FIG. 68 is an enlarged isometric view of the connection between a contact strip and the surge protector.
Figure 67:
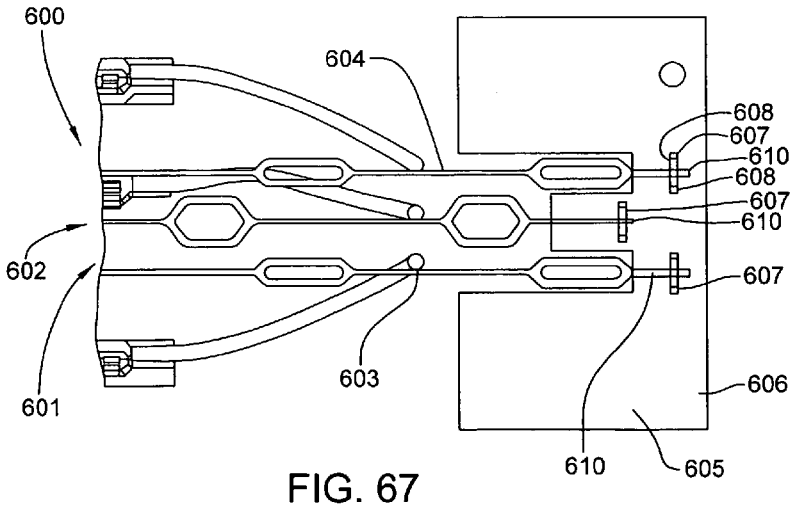
FIG. 67 is a plan view of a modified receptacle with a circuit-board based surge protector connected thereto.

Additionally, any of the above receptacles may be adapted to include a surge protector capability. Referring to FIGS. 67 and 68, hot and neutral contact strip assemblies 600 and 601 and a ground contact strip assembly 602 are illustrated. In accord with the above discussion, each of these contact strip assemblies includes a respective contact strip 603 or 604 which contact strips are adapted to readily connect to a surge protector 605.

The surge protector 605 comprises a circuit board 606 and is designed according to conventional design principals. However, such surge protector 605 is adapted to connect to the contact strips 604 or 603. In this regard, the surge protector 605 includes three sets 607 of upstanding connector prongs 608 which define electrical connections to the circuit board components. The prongs 608 are spaced apart and project upwardly wherein the opposed inside faces of each set 607 of prongs 608 are electrically conductive.

Each contact strip 604 or 603 further includes and end tab 610 which extends longitudinally through and slides downwardly into a respective set 607 of the prongs 608. As such, each contact strip 604 or 603 connects to the surge protector 605 through the electrical connection between the contact strip tab 610 and the opposed faces of a respective set 607 of prongs 608.

Thus, a surge protector 605 may be added to any receptacle by appropriate design of the housing and the contact strips therein.

With the foregoing receptacle constructions, various receptacles may be constructed using common internal contact strip assemblies and component parts therefore. Further, the support projections or support structure located within the receptacle housings is substantially the same and the general shape and configuration of these support projections may be maintained while varying the dimension of such support projections in the front to back direction. Thus, a common support structure and construction of the contact strip assemblies may be maintained within various configurations for receptacle housing.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In an electrical receptacle for a power distribution system for use with an elongate power distribution assembly having a plurality of electrical conductors extending longitudinally therein said conductors comprising at least one hot conductor and one neutral conductor to define at least one circuit and comprising at least one ground conductor associated with said circuit, said power distribution assembly further including access ports which provide access to said conductors, said electrical receptacle having a housing with a back wall and front wall, and electrical terminals that are configured to engage rearwardly from said back housing wall with said conductors of said power distribution assembly through said access ports for electrical connection of said receptacle with at least one said electrical circuit of said power distribution assembly, said receptacle further including groups of plug openings which are accessible through said front housing wall and are adapted to receive a multiprong electrical plug therein; comprising the improvement wherein said receptacle includes contact strip assemblies which are supported within said housing and are adapted to respectively connect to at least a hot conductor and a neutral conductor of said power distribution assembly, each said contact strip assembly including an elongate contact strip mounted adjacent to an inside face of said front housing wall of said receptacle housing and are accessible adjacent to said plug openings thereof and a respective one of said electrical terminals supported on said back housing wall and adapted to engage said ports of said power distribution assembly for removable engagement with a respective one of said conductors, each said contact strip including a plurality of spaced apart contact seats each adapted to tight-fittingly receive a prong of an electrical plug wherein said prong seats each align with a respective one of said prong openings and said prong seats are joined together by an intermediate web of conductive material, said contact strip and said respective terminal being joined together with a flexible intermediate conductor wherein one end of said intermediate conductor is joined to said terminal and the other end of said intermediate conductor is joined to said web of said contact strip, said intermediate conductor being flexible in a front-to-back direction between said front and back housing walls to permit displacement of said terminal relative to said contact strip in the front-to-back direction, and also being flexible laterally to permit movement of said terminal parallel to said front and back housing walls.

2. The electrical receptacle according to claim 1, wherein said intermediate conductor is a cable comprising an interior wire and an exterior insulative layer.

3. The electrical receptacle according to claim 2, wherein said front and back walls of said housing are defined by respective front and back housing sections which are engagable together to define a hollow interior of said housing, one said housing section including support walls which project inwardly from one of said front and rear walls and define shaped spaces into which said contact strips are stationarily received, said support walls having a height which corresponds to a height which terminates adjacent an edge of said contact strips in the front-to-back direction, the other said housing including an adjacent face which abuts against distal ends of said support walls adjacent said edge of each said contact strip to confine said contact strips within said shaped spaces.

4. The electrical receptacle according to claim 1, wherein said front and back housing walls are defined by respective front and back housing sections which are engageable together to define a hollow interior of said housing, one said housing section including support walls which project inwardly and define shaped spaces into which said contact strips are stationarily received, said support walls having a height which terminates adjacent an edge of each said contact strip, the other said housing including a surface which faces distal ends of said support walls to confine said contact strips within said shaped spaces.

5. The electrical receptacle according to claim 4, wherein said back wall includes insulative terminal posts which project from said back wall and are adapted to be inserted within said conductor ports on said power distribution assembly, said insulative posts being hollow and having said respective terminals stationarily seated therein, said intermediate conductor permitting insertion of said contact strips within said shaped spaces and insertion of said terminals within said post before assembly of said front housing wall and said back housing wall together.

6. The electrical receptacle according to claim 5, wherein at least one of said posts is mounted on a slide block which is slidably supported on said back housing section and displaceable parallel to said back housing wall, said conductor being flexible generally in the direction of movement of said slide block.

7. The electrical receptacle according to claim 1, wherein said receptacle includes a ground contact strip assembly having an elongate contact strip mounted adjacent to said front housing wall and accessible through said plug openings thereof and one of said electrical terminals which is disposed within a further one of said posts of said back wall, said ground terminal being rigidly supported by said contact strip of said ground contact strip assembly.

8. In an electrical receptacle for a power distribution system comprising an elongate power distribution assembly having a plurality of electrical conductors extending longitudinally therein, said conductors comprising at least one hot conductor, and one neutral conductor to define at least one circuit and comprising at least one ground conductor associated with said circuit, said power distribution assembly further including access ports which provide access to said conductors, said receptacle having a housing with a back wall and a front wall, and electrical terminals that are configured to engage rearwardly from said back housing wall with said conductors of said power distribution assembly through said access ports for electrical connection of said receptacle with at least one said electrical circuit of said power distribution assembly, said receptacle further including groups of plug openings which are accessible through said front housing wall and are adapted to receive a multiprong electrical plug therein, comprising the improvement wherein said receptacle includes contact strip assemblies which are adapted to respectively connect to a hot conductor and a neutral conductor of said power distribution assembly, each said contact strip assembly including an elongate contact strip mounted adjacent to an inside face of said front housing wall and being accessible through said plug openings thereof, and further including an associated one of said electrical terminals supported on said back housing wall and adapted to engage said ports of said power distribution assembly for removable engagement with a respective one of said conductors, each said contact strip including a plurality of spaced apart contact seats each adapted to tight-fittingly receive a prong of an electrical plug wherein said prong seats each align with a respective one of said prong openings and said prong seats are joined together by an intermediate web of conductive material, said receptacle further including a molded support arrangement comprised upstanding support walls which span the distance between said front and back housing walls and defined shaped spaces adjacent to said inside face of said front housing wall in which each said contact strip is supported.

9. The electrical receptacle according to claim 8, wherein said support arrangement defines a plurality of pockets in which said contact seats are disposed in alignment respectively with said openings.

10. The electrical receptacle according to claim 9, wherein said support arrangement defines slots disposed between said support pockets through which said intermediate webs of said contact strips.

11. The electrical receptacle according to claim 10, wherein said support arrangement comprises a plurality of interior walls which extend generally parallel to each other along said front housing wall to define a plurality of support pockets and aligned slots for supporting a middle one of said contact strips.

12. The electrical assembly according to claim 11, wherein said support arrangement includes outer support walls which are spaced apart from said inner walls to define additional pockets and slots for supporting a pair of said contact strips on opposite sides of said middle contact strip, said outer contact strips positioned for contact with hot and neutral conductors and said middle contact strip positioned for contact with ground conductors.

13. The electrical receptacle according to claim 12, wherein each of said contact strips is defined by a flat strap of conductive material which is mechanically shaped in the region of said contact seats to define said contact seats in a predefine spaced relation.

14. The electrical receptacle according to claim 8, wherein each said contact strip is adapted for connection to a hot conductor and a neutral conductor and are connected to its respective terminal by a flexible conductor, said flexible conductor being flexible to permit displacement of said terminal relative to its associated contact strip.

15. An electrical receptacle for connection to a modular power distribution assembly having a plurality of circuits therein, said receptacle comprising;

a housing defining a hollow interior which includes spaced apart first and second walls that define said hollow interior therebetween, said first wall facing rearwardly and having terminal openings therein, and said second wall having groups of outlet openings therein which are adapted to receive hot, neutral and ground prongs of an electrical plug;

a plurality of contact strip assemblies respectively positioned along said openings associated with said hot prongs, said neutral prongs and said ground prongs, said hot and neutral contact strip assemblies each comprising a contact strip which is elongate and defines tubular contact seats which are adapted to receive hot and neutral prongs of a conventional electrical plug, said contact strips including intermediate webs of said contact strip material which joins said contact seats together in spaced apart relation so that said contact seats are adapted to align with said openings in said second housing wall, at least said hot and neutral contact strip assemblies further including an electrical terminal configured to engage an electrical conductor disposed exteriorly of said receptacle and a flexible intermediate conductor which is connected at its opposite ends to said terminal ends of said contact strip; and an interior support arrangement disposed within said hollow receptacle interior, said support arrangement projecting from an inside face of said housing to define shaped pockets disposed directly adjacent to said outlet openings which said shaped pockets are adapted to receive and support said contact strips directly adjacent to said inside face of said second housing wall so that said contact seats are aligned respectively with said openings of said second housing wall, said terminals of said contact strip assemblies being supported within said terminal openings of said first housing wall with said flexible intermediate conductor permitting displacement of said terminals relative to said contact strips.

16. The electrical receptacle according to claim 15, wherein said first and second housing walls are disposed in opposing relation and said support arrangement spans a distance between said first housing wall and said second housing wall.

17. The electrical receptacle according to claim 15, wherein said contact strips for each of said contact strip assemblies are formed from a common conductive stock material formed of metal.

18. The electrical receptacle according to claim 15, wherein said first housing wall includes a slide block slidably supported on said first housing wall which includes insulated posts projecting from said first housing wall for engagement with exterior conductors, said slide blocks supporting said terminals respectively within said posts wherein said terminals move along said first housing wall in association with said slide block with said intermediate conductors being flexible during sliding movement of said slide block.

19. The electrical receptacle according to claim 18, wherein at least one of said terminals of said contact strip assemblies is stationarily mounted on said first housing wall and remains stationary during movement of said slide block.

20. The electrical receptacle according to claim 19, wherein said stationary terminal comprises a first set of contact fingers which project exteriorly of said receptacle for engagement with an exterior conductor and a second set of contact fingers which project interiorly and engage said contact strip of one contact strip assembly.

21. The electrical receptacle according to claim 20, wherein said one contact strip assembly is aligned with said outlet openings which are associated with a ground prong of an electrical plug in said stationary terminal is configured for engagement with an exterior ground conductor.

* * * * *